US006910543B2

(12) United States Patent
Kanno et al.

(10) Patent No.: US 6,910,543 B2
(45) Date of Patent: Jun. 28, 2005

(54) CARE TYPE ELECTRIC WHEELCHAIR

(75) Inventors: Nobuyuki Kanno, Iwata (JP); Mitsuo Miyazaki, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 283 days.

(21) Appl. No.: 10/009,555

(22) PCT Filed: Feb. 28, 2001

(86) PCT No.: PCT/JP01/01537

§ 371 (c)(1),
(2), (4) Date: Mar. 12, 2002

(87) PCT Pub. No.: WO01/62197

PCT Pub. Date: Aug. 30, 2001

(65) Prior Publication Data

US 2003/0098190 A1 May 29, 2003

(30) Foreign Application Priority Data

| | | |
|---|---|---|
| Feb. 28, 2000 | (JP) | 2000-051111 |
| Feb. 28, 2000 | (JP) | 2000-051112 |
| Jul. 14, 2000 | (JP) | 2000-214347 |
| Sep. 5, 2000 | (JP) | 2000-268845 |

(51) Int. Cl.[7] ..... B62D 51/04
(52) U.S. Cl. ..... 180/65.1; 180/19.3; 180/907
(58) Field of Search ..... 180/19.1, 19.2, 180/19.3, 65.1, 65.2, 65.5, 65.8, 907; 280/280.1, 304.1; 701/22, 41, 42, 43

(56) References Cited

U.S. PATENT DOCUMENTS

| | | | | |
|---|---|---|---|---|
| 3,876,024 A | * | 4/1975 | Shieman et al. | 180/19.1 |
| 4,037,676 A | * | 7/1977 | Ruse | 180/6.5 |
| 4,646,860 A | * | 3/1987 | Owens et al. | 180/19.2 |
| 5,937,959 A | * | 8/1999 | Fujii et al. | 180/12 |
| 5,937,961 A | * | 8/1999 | Davidson | 180/166 |
| 6,003,627 A | * | 12/1999 | Ishida | 180/206 |
| 6,009,964 A | * | 1/2000 | Ishida | 180/6.5 |
| 6,536,544 B1 | * | 3/2003 | Egawa et al. | 180/19.3 |
| 6,560,515 B2 | * | 5/2003 | Inoue | 701/22 |
| 6,588,523 B2 | * | 7/2003 | Heimbrock et al. | 180/65.5 |

FOREIGN PATENT DOCUMENTS

| | | |
|---|---|---|
| JP | 6-304207 | 11/1994 |
| JP | 9-130921 | 5/1997 |
| JP | 11-276526 | 10/1999 |
| JP | 2000-42044 | 2/2000 |

* cited by examiner

*Primary Examiner*—Christopher P. Ellis
*Assistant Examiner*—Bridget Avery
(74) *Attorney, Agent, or Firm*—Ernest A Beutler

(57) ABSTRACT

A bar handle 5 is provided to extend from the rear parts of right and left side frames 3 and to form a gate shape in a double member structure made up of a fixed member 32 attached to the rear parts of the right and left side frames 3 and a movable member 33 disposed along at least upper side portion of the fixed member 33. A displacement detecting means 42 is interposed between the fixed member 32 and the movable member 33 to detect displacement of the movable member 33 relative to the fixed member 32. A control means is provided to control a driving motor so as to produce assisting power commensurate with the detected displacement.

18 Claims, 35 Drawing Sheets

[FIG. 1]
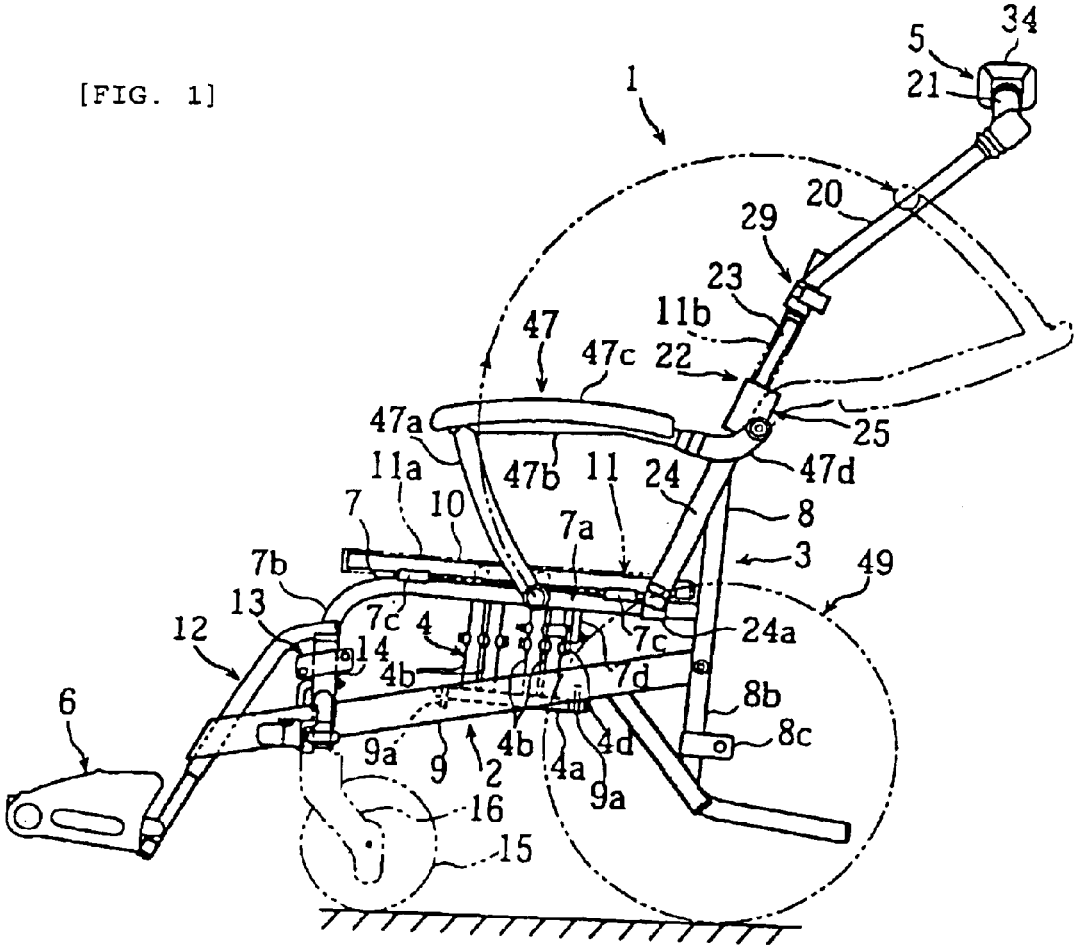

[FIG. 2]
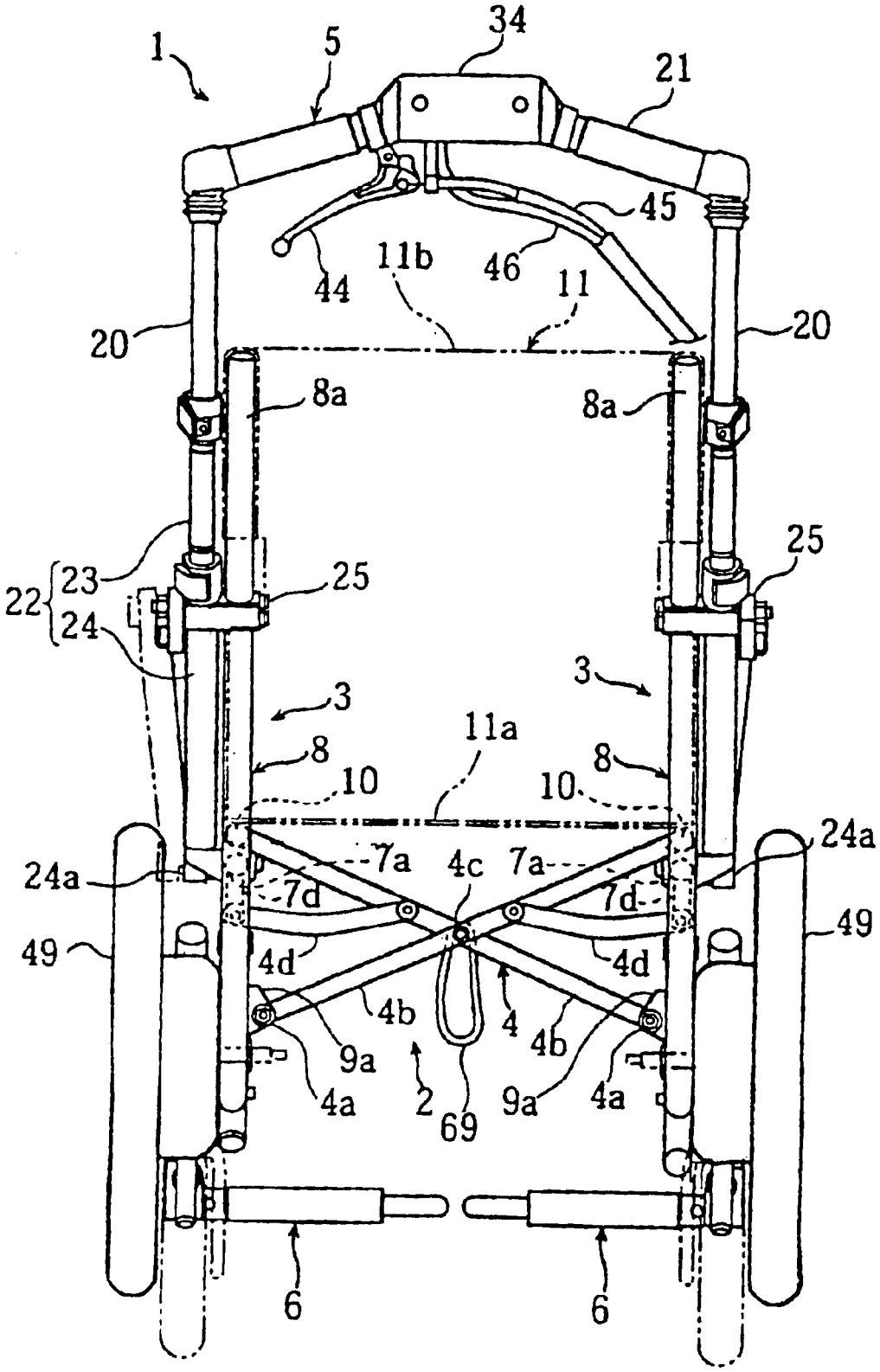

[FIG. 3]
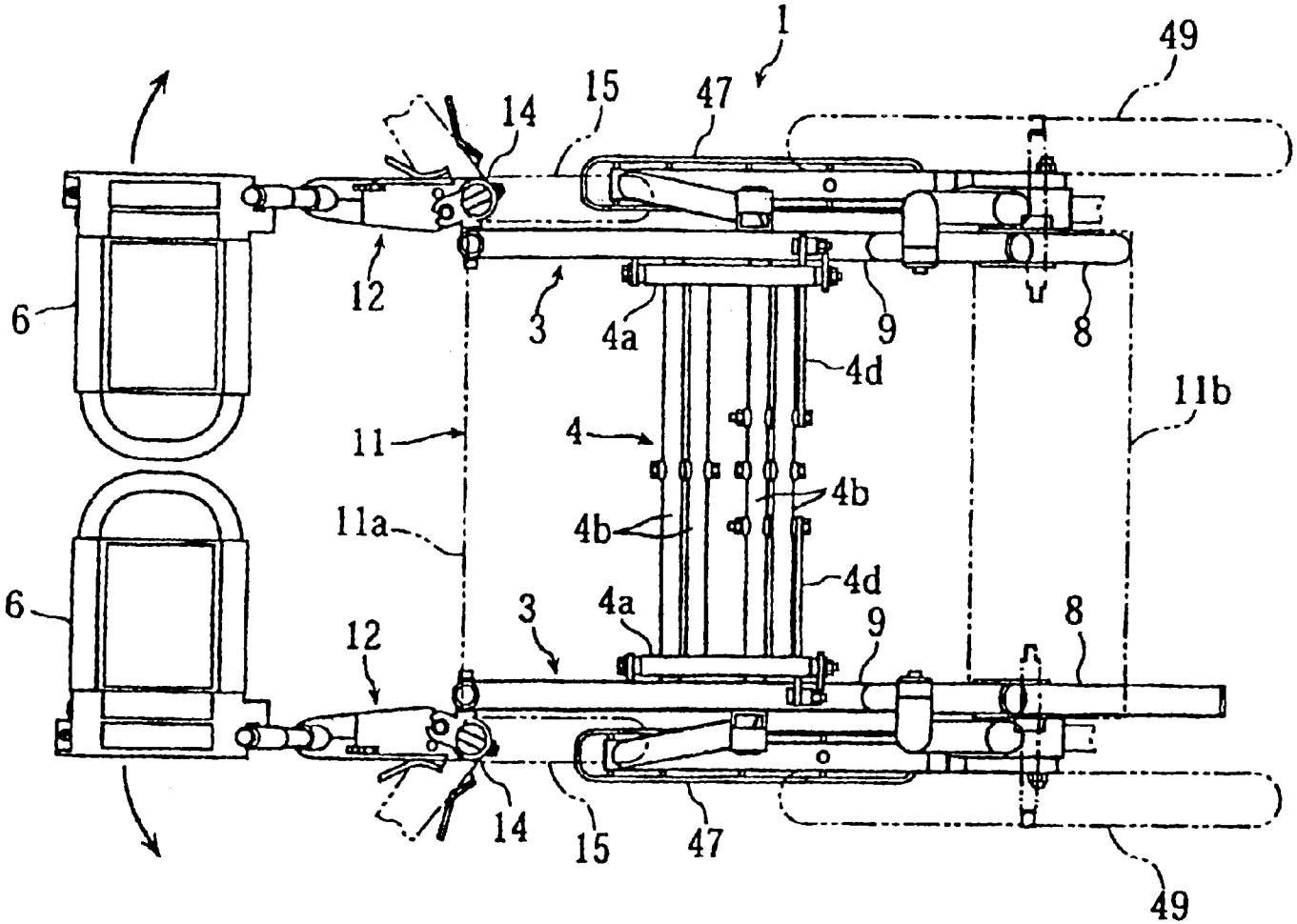

[FIG. 4]
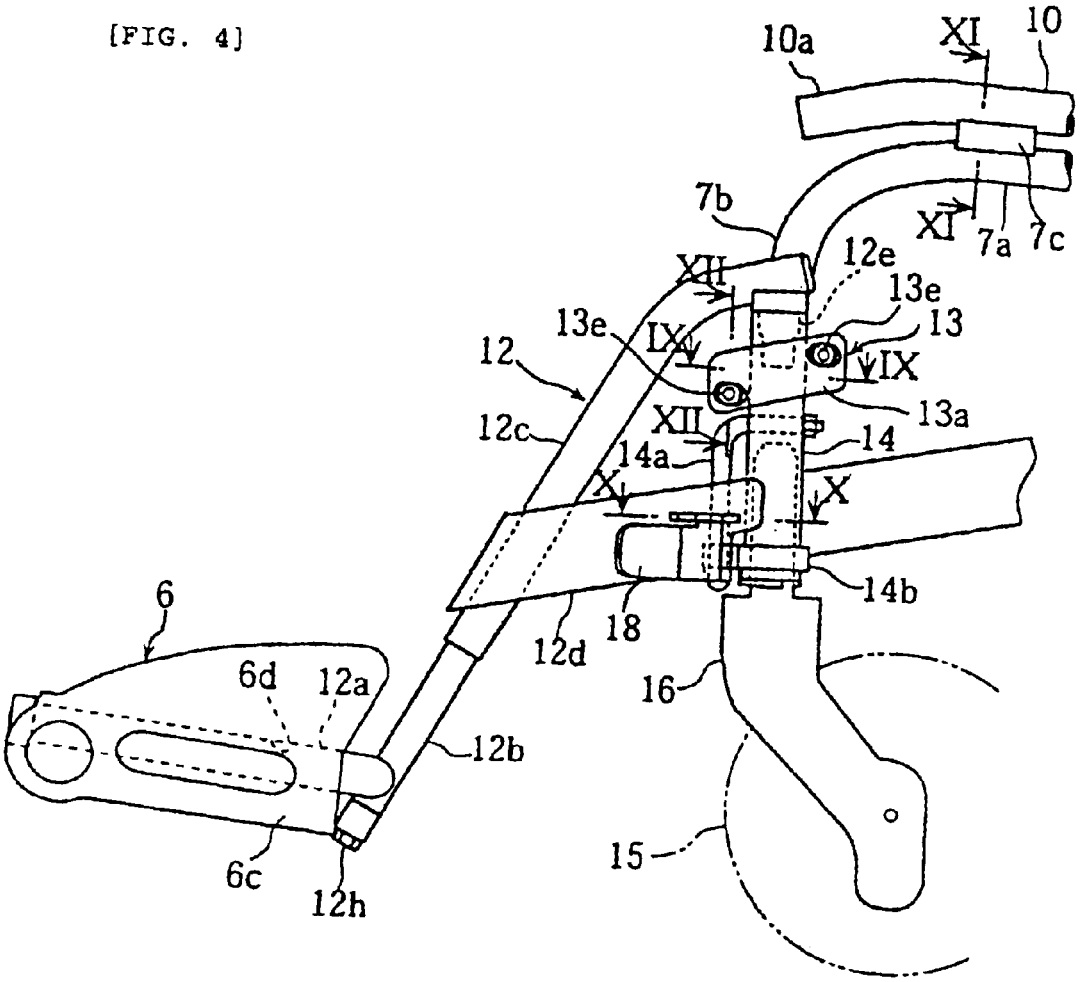

[FIG. 5]
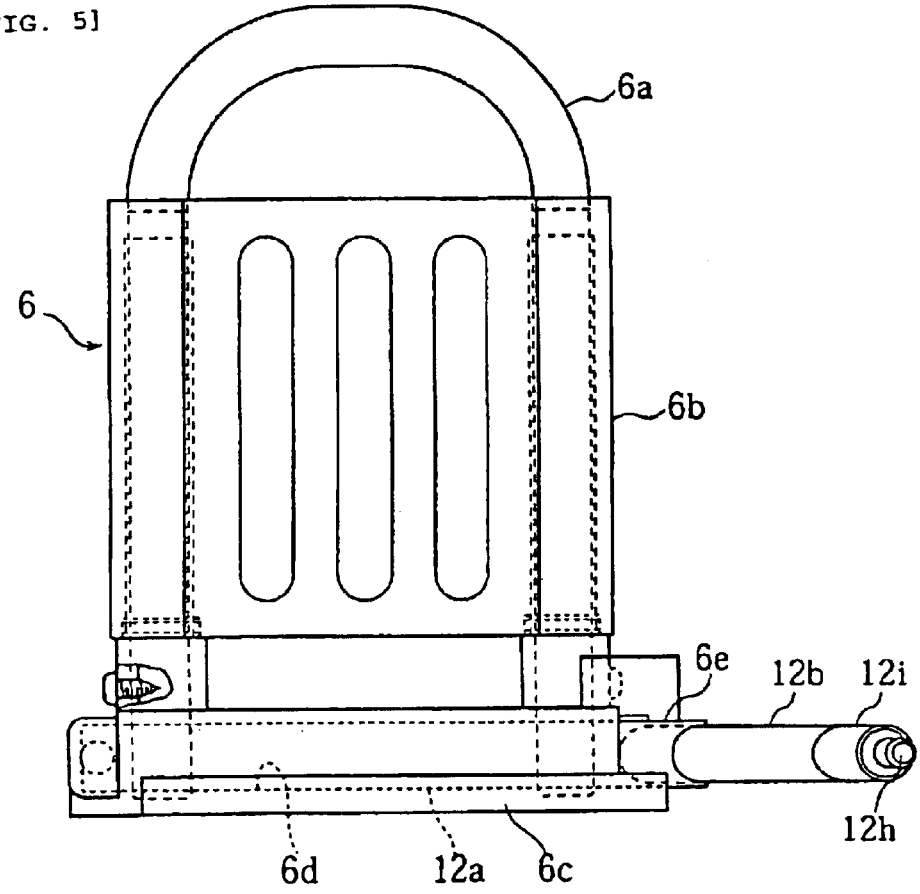
[FIG. 6]
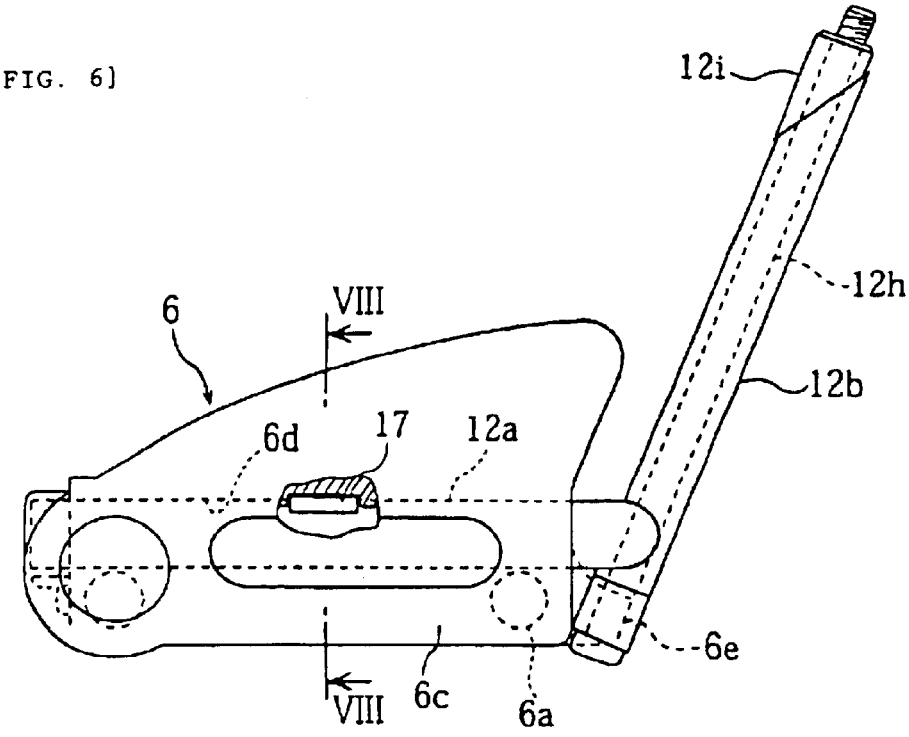

[FIG. 7]
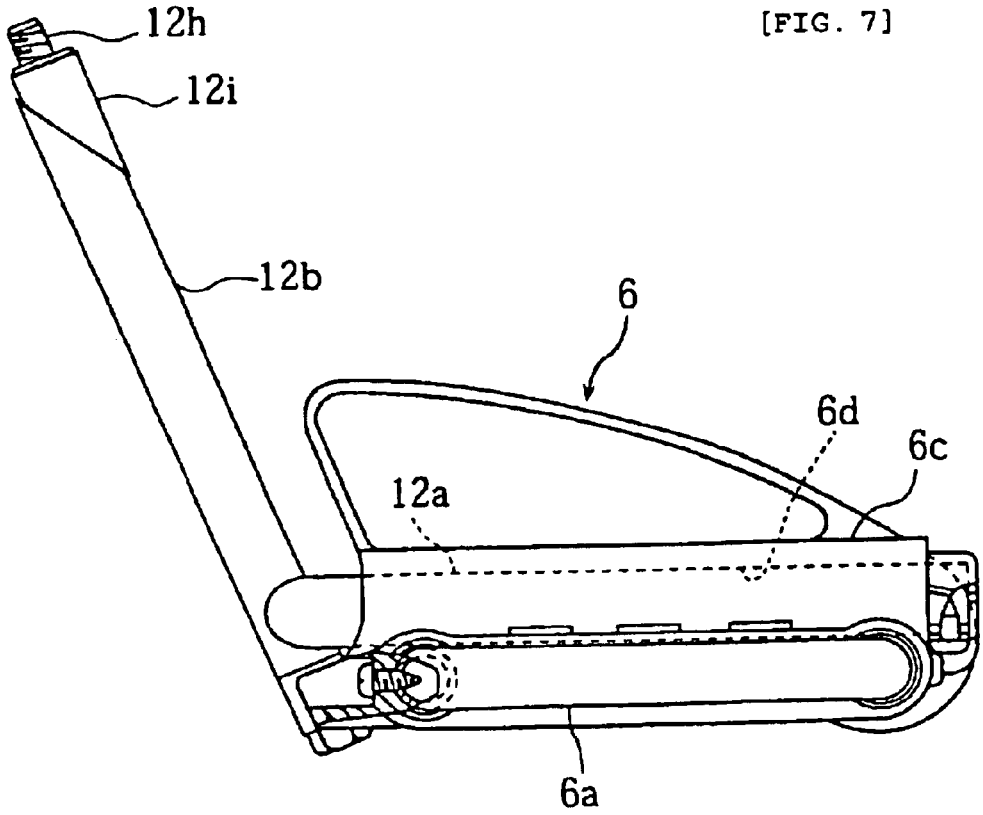
[FIG. 8]
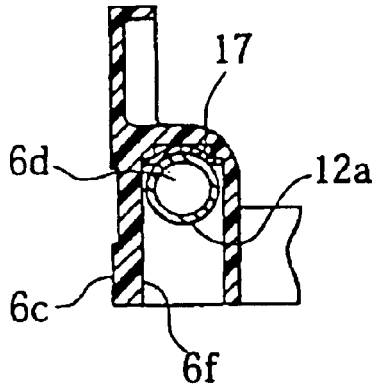
[FIG. 9]
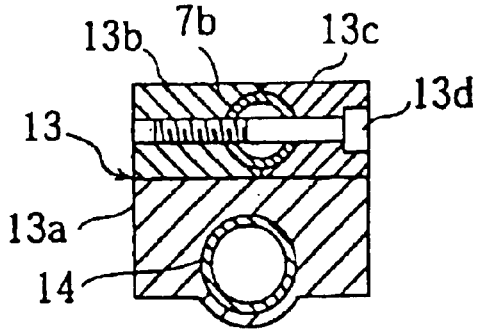

[FIG. 10]
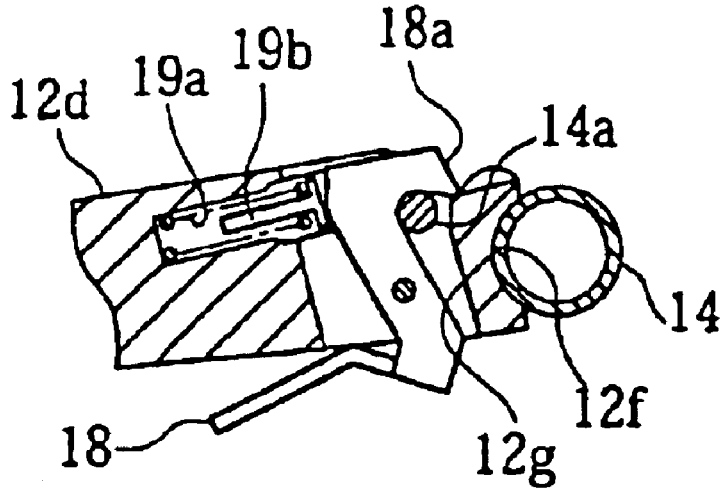
[FIG. 11]
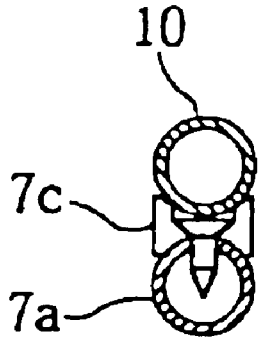
[FIG. 12]
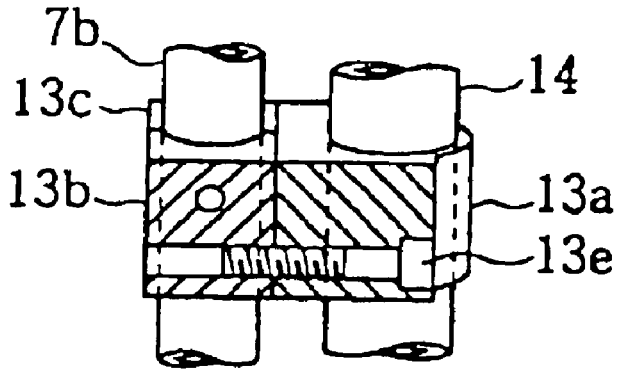

[FIG. 13]
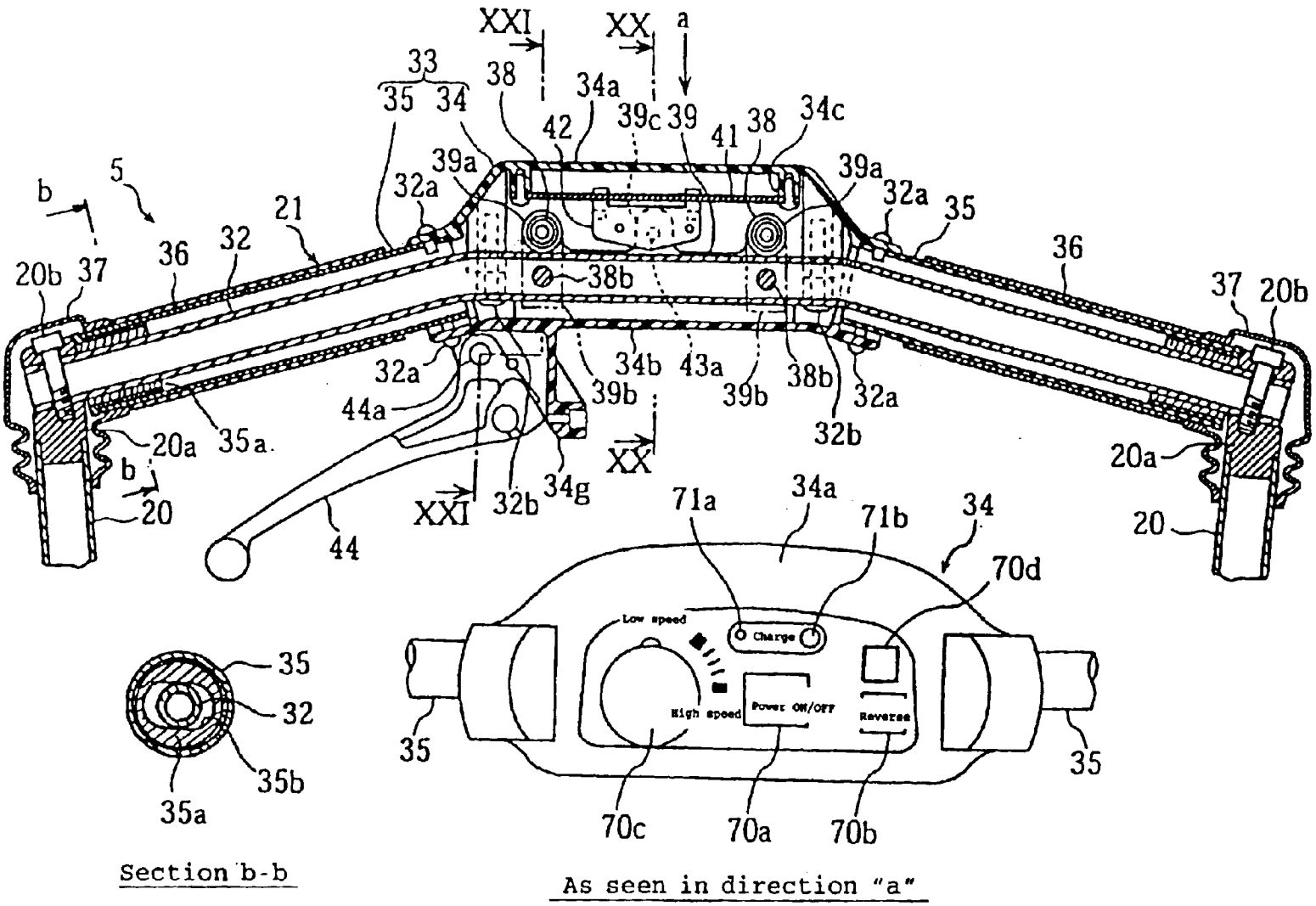

[FIG. 14]
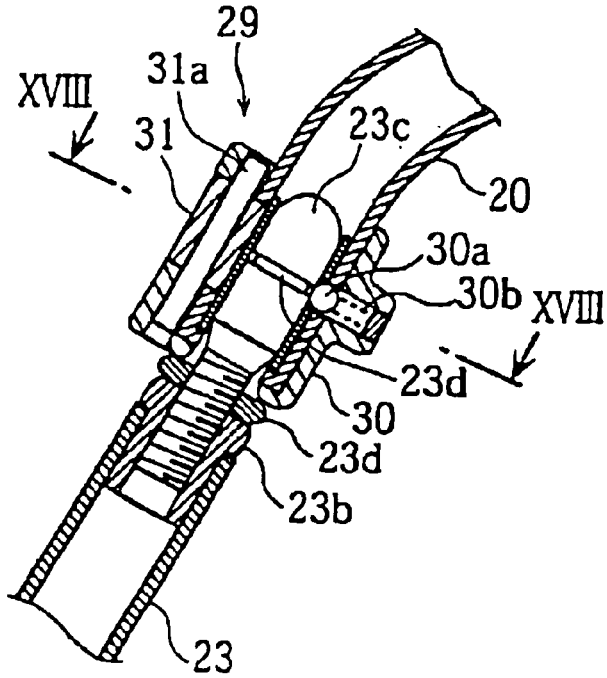
[FIG. 15]
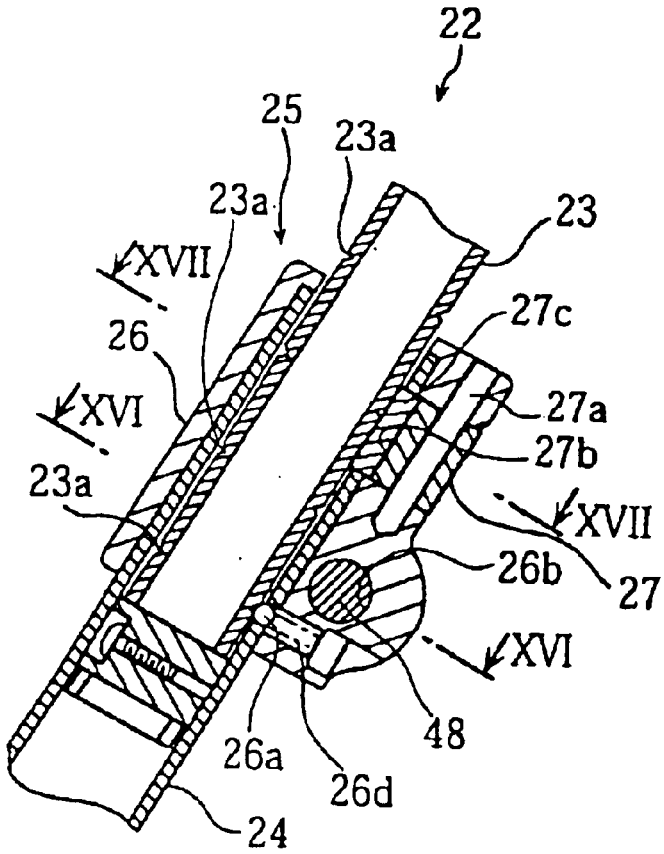

[FIG. 16]
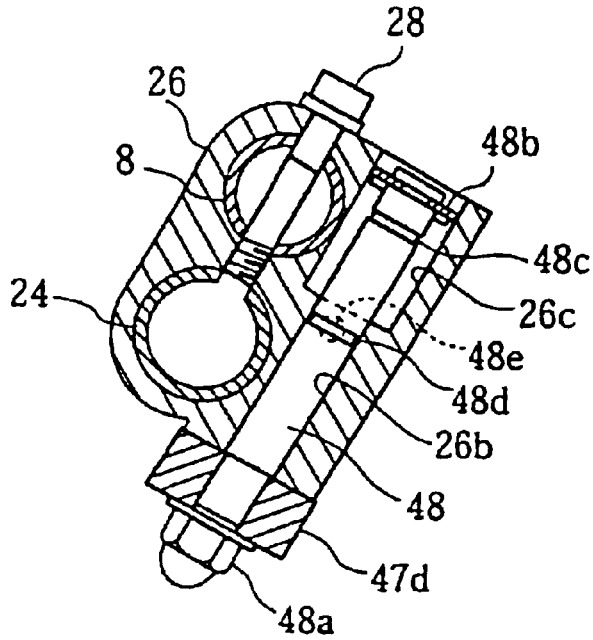
[FIG. 17]
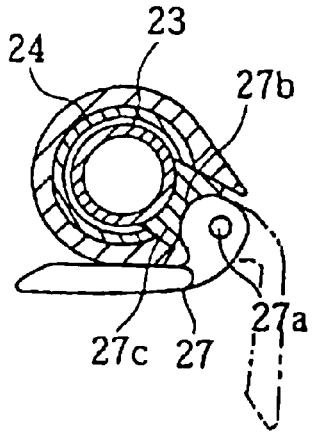
[FIG. 18]
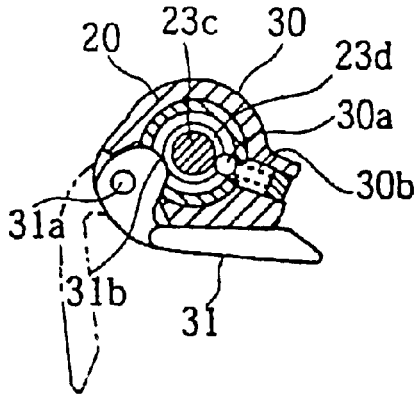

[FIG. 19]
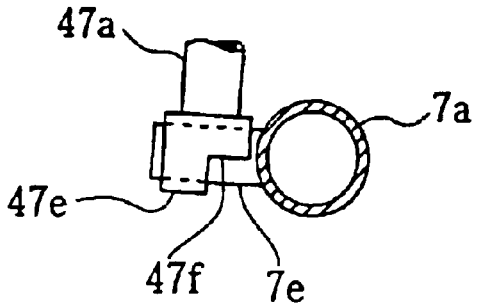
[FIG. 20]
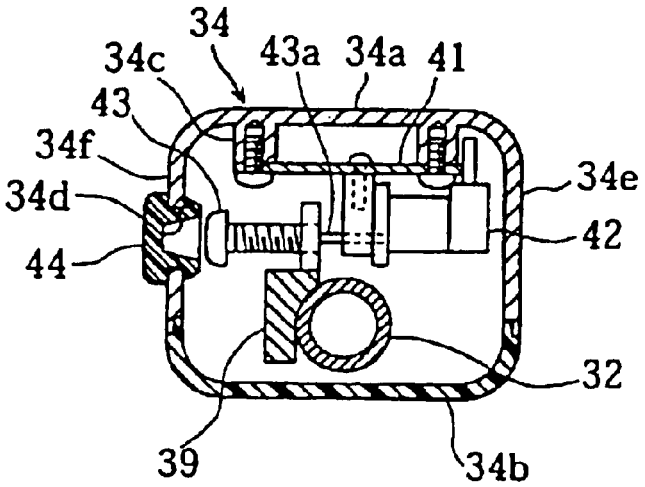
[FIG. 21]
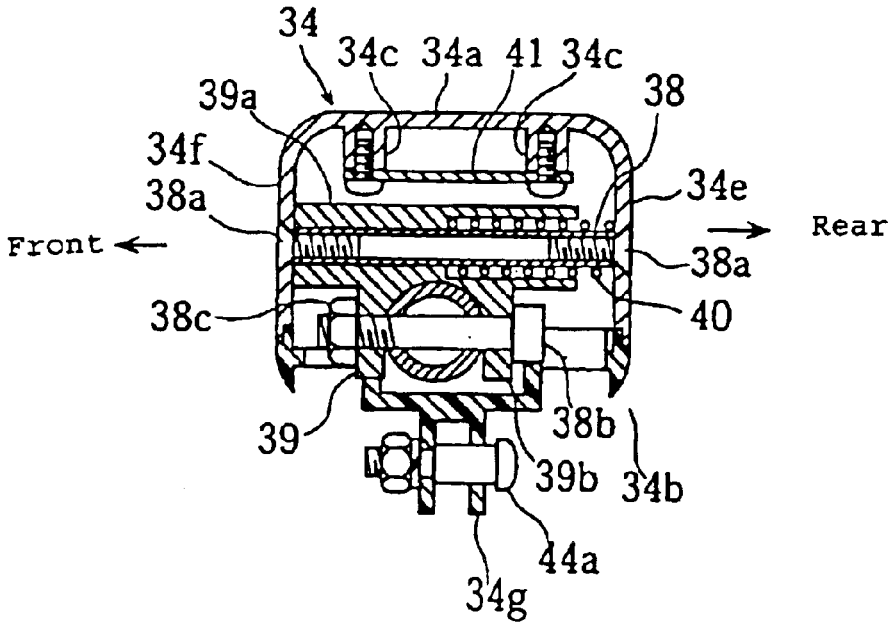

[FIG. 22]
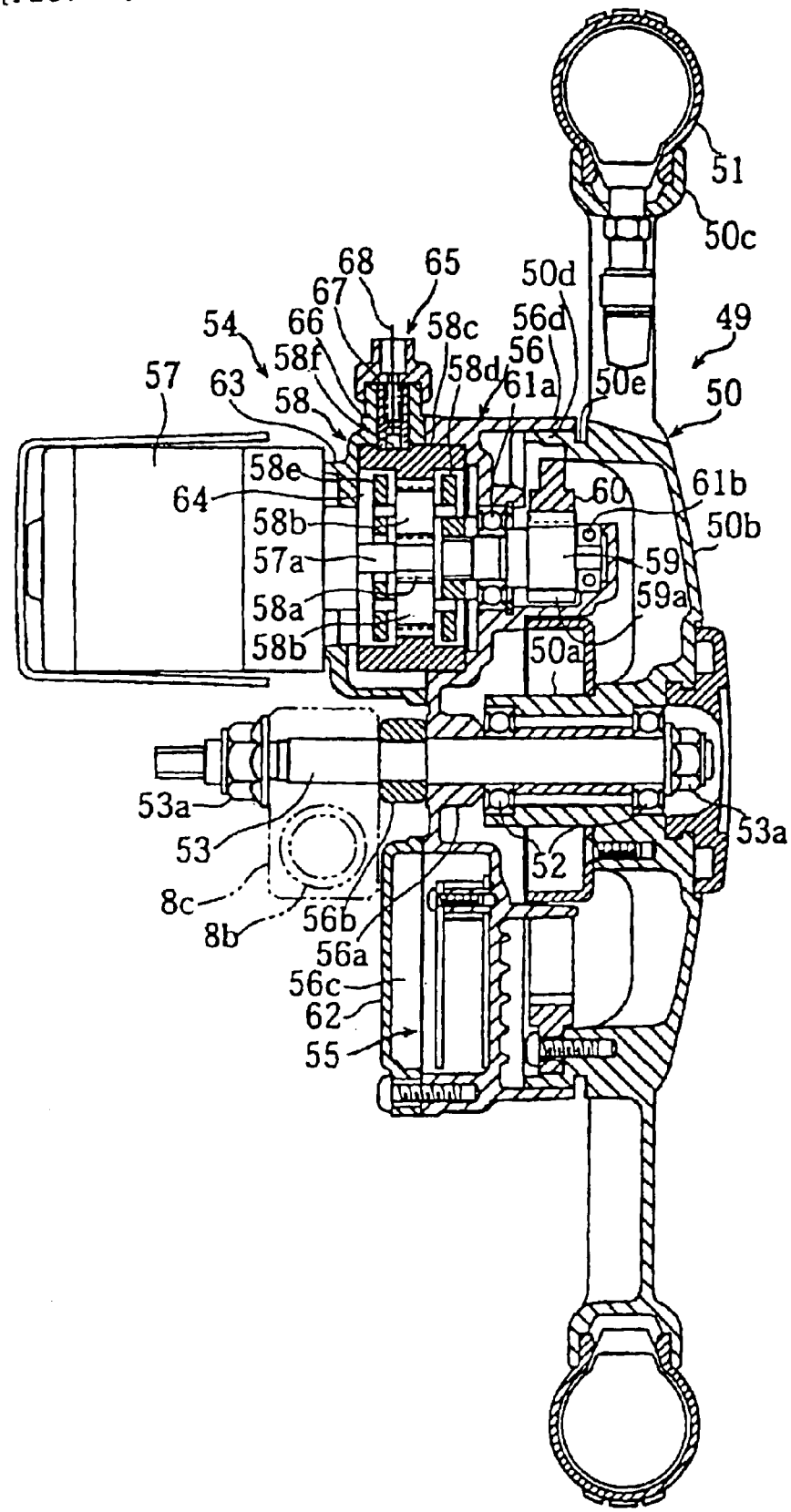

[FIG. 23]
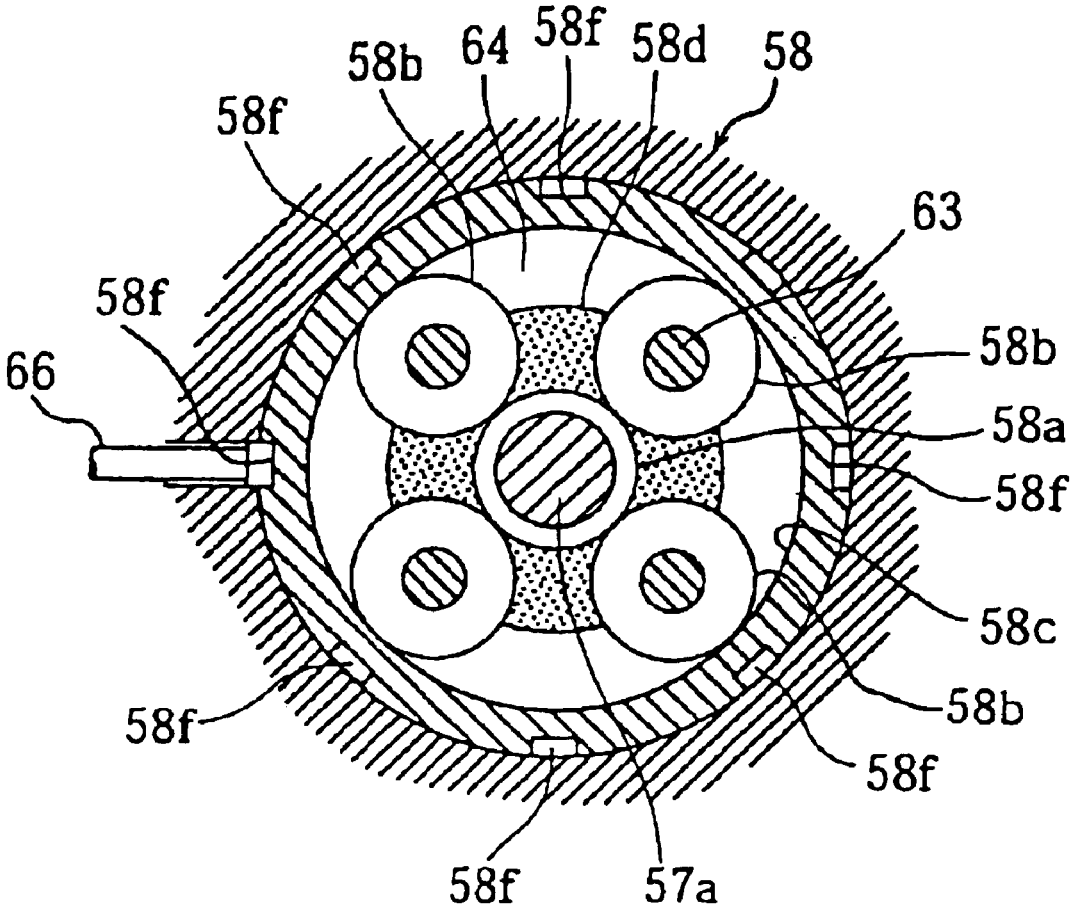

[FIG. 24]
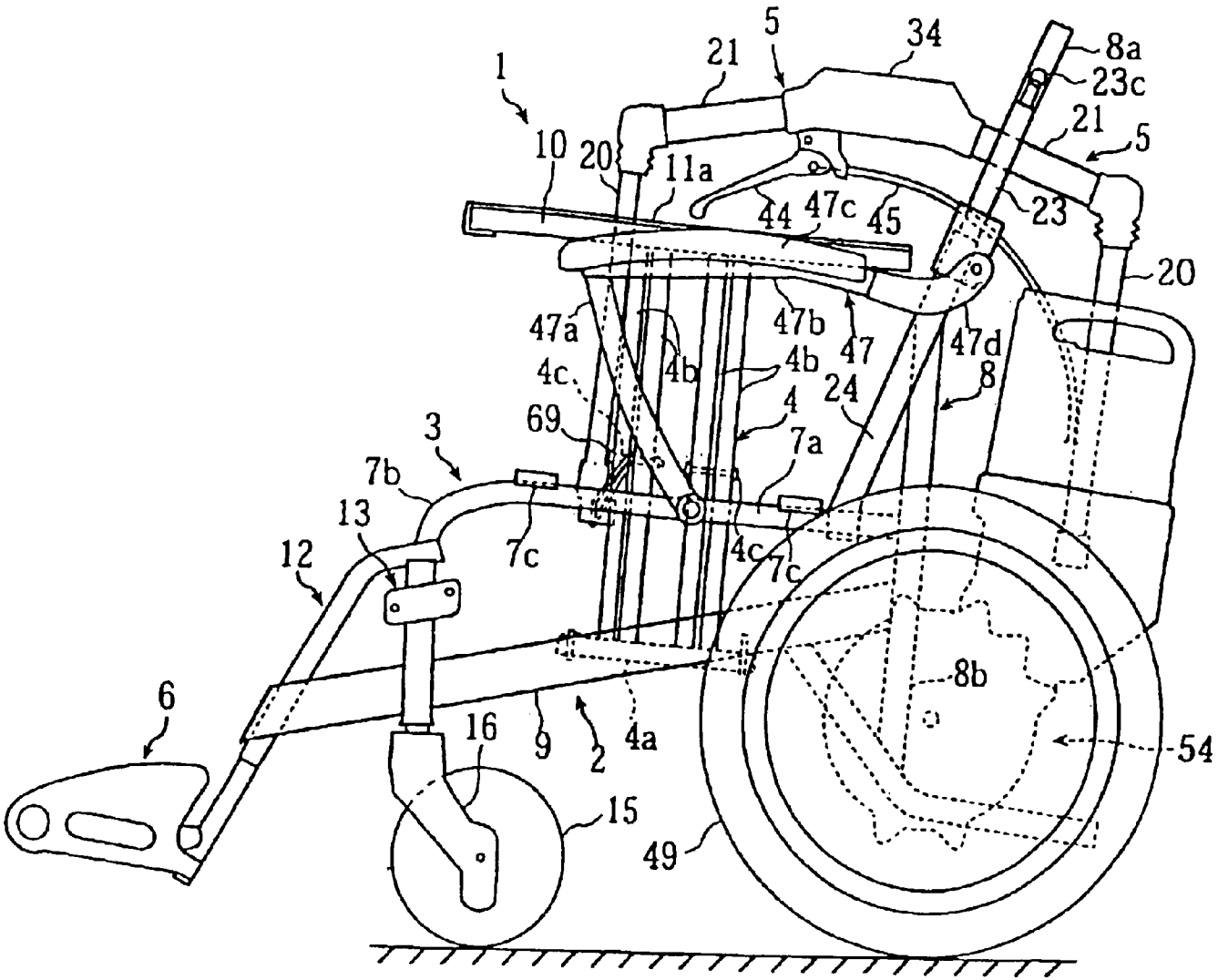

[FIG. 25]
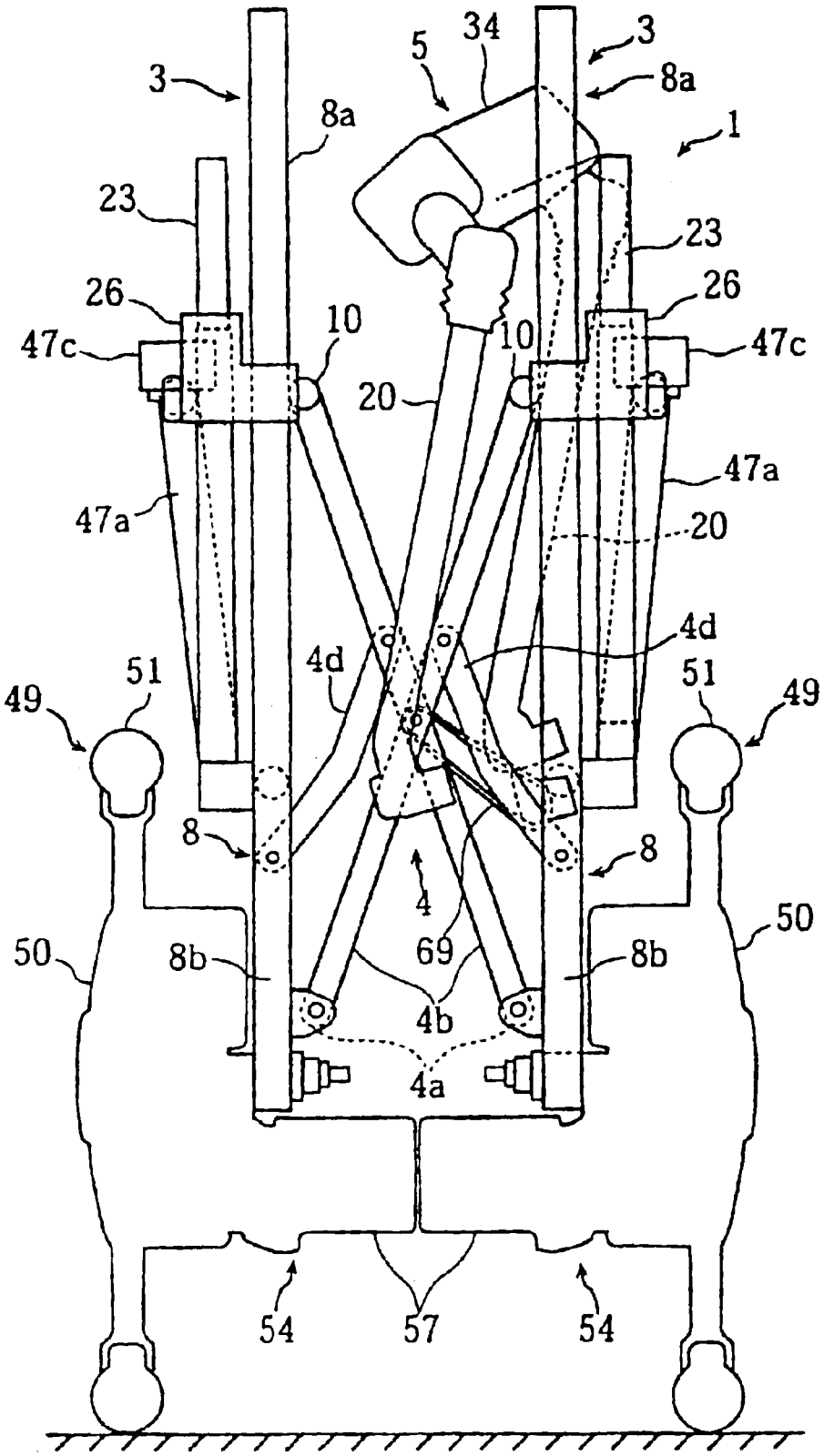

[FIG. 26]
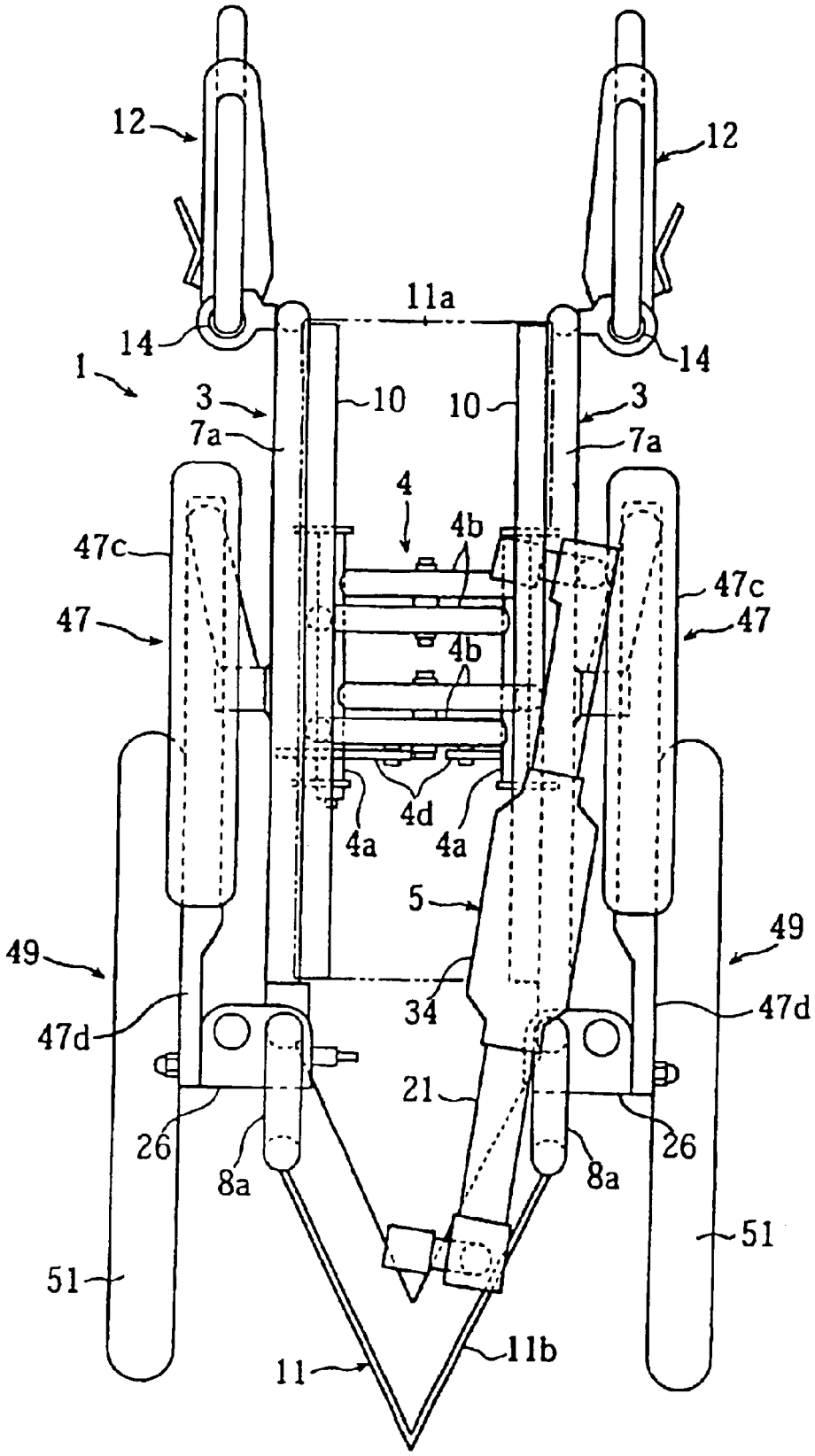

[FIG. 27]
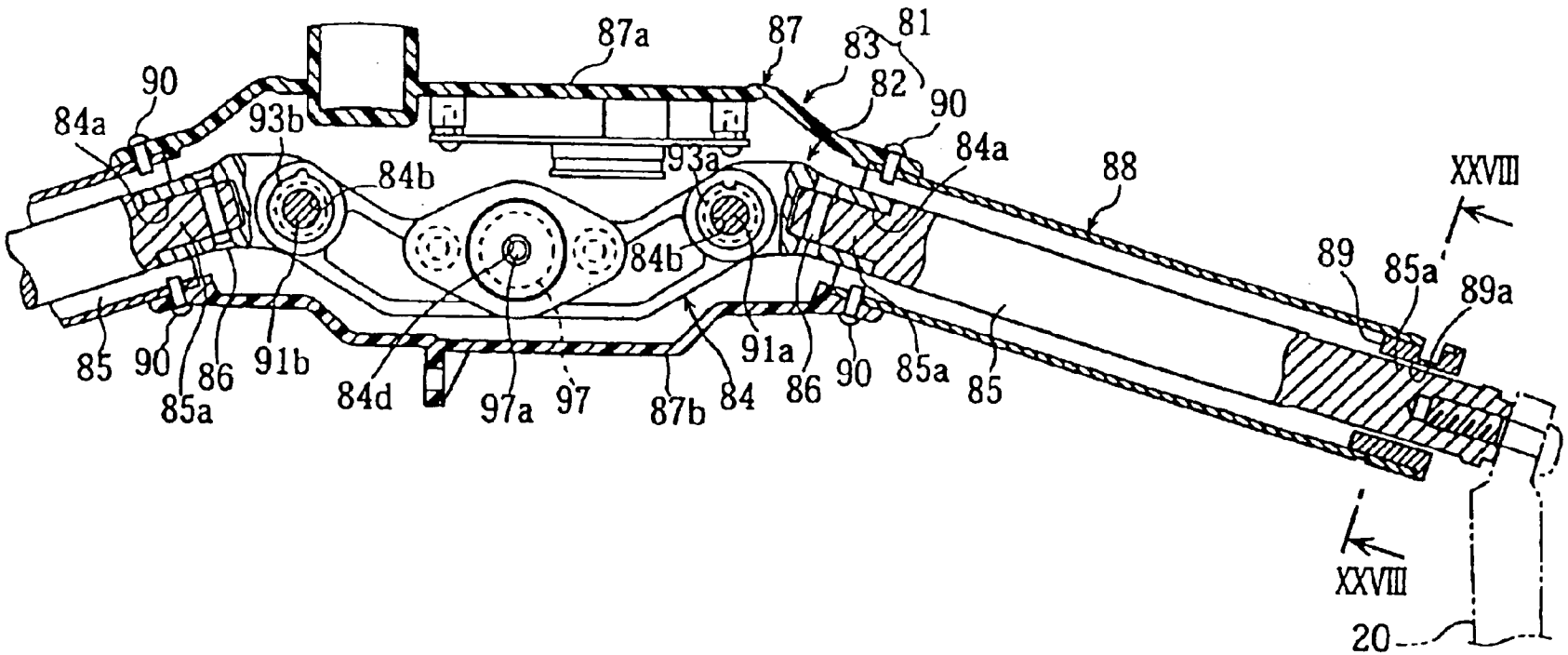

[FIG. 28]
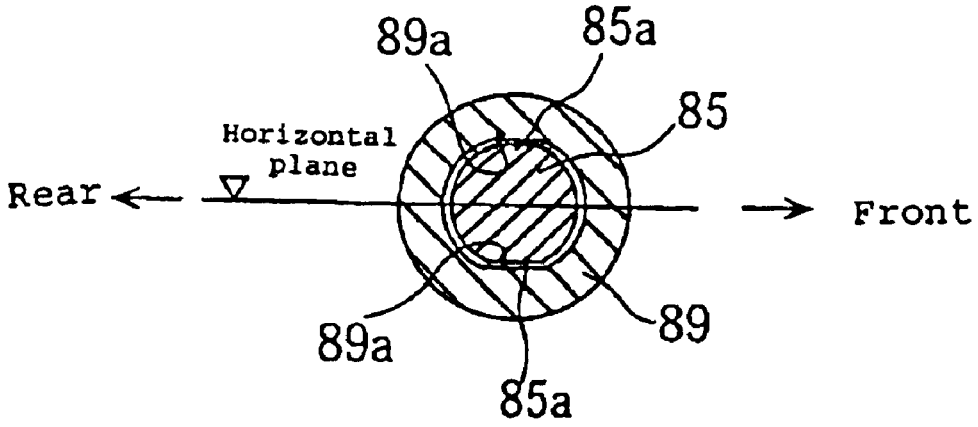

[FIG. 29]
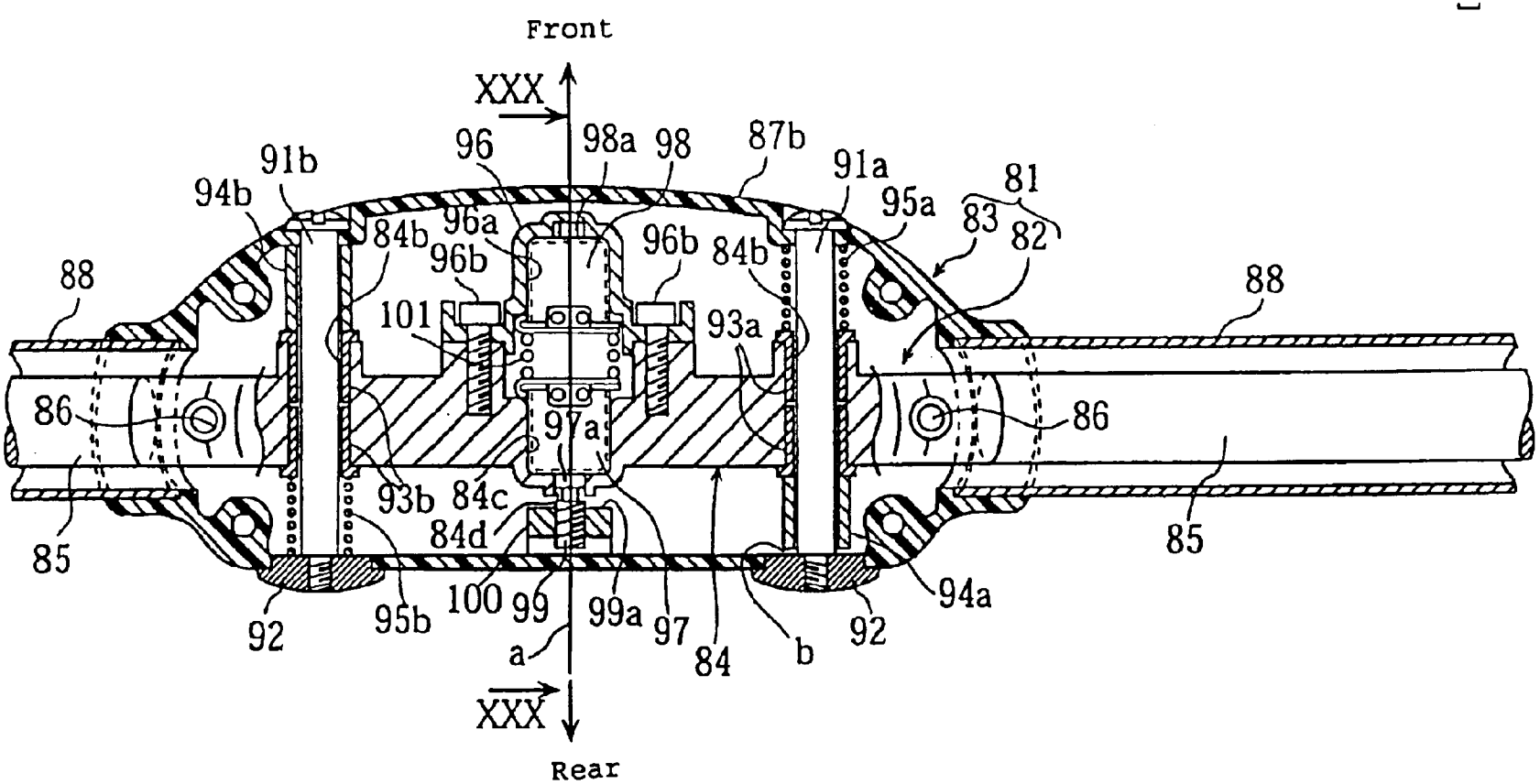

[FIG. 30]
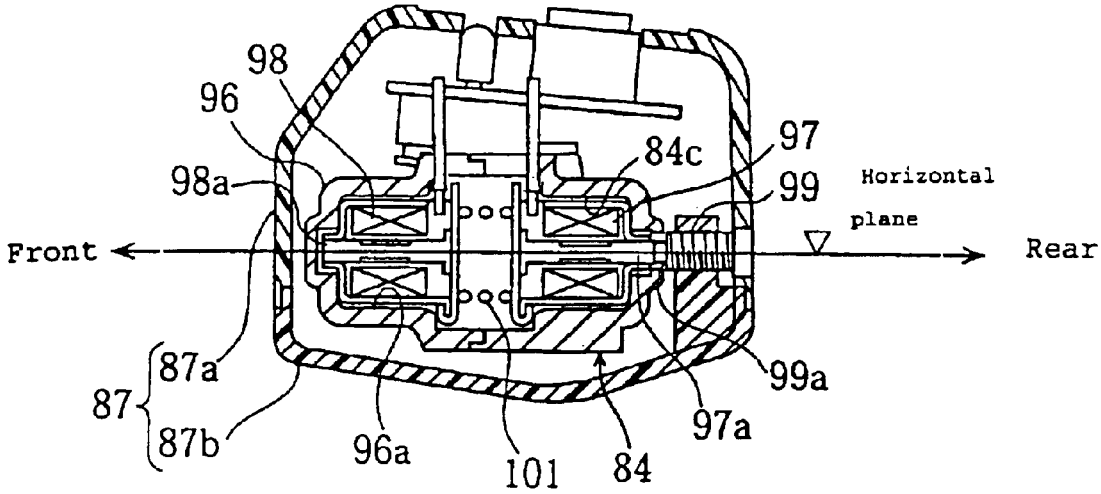

[FIG. 31]
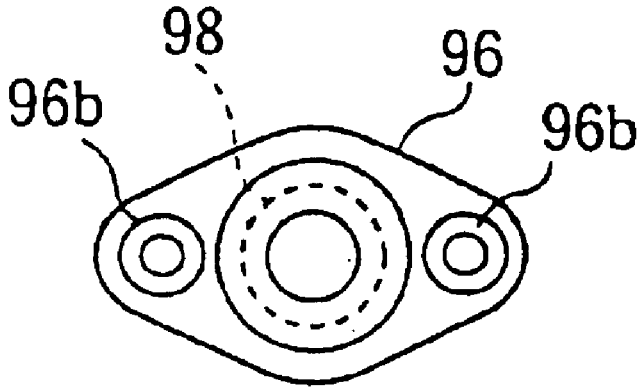

[FIG. 32]
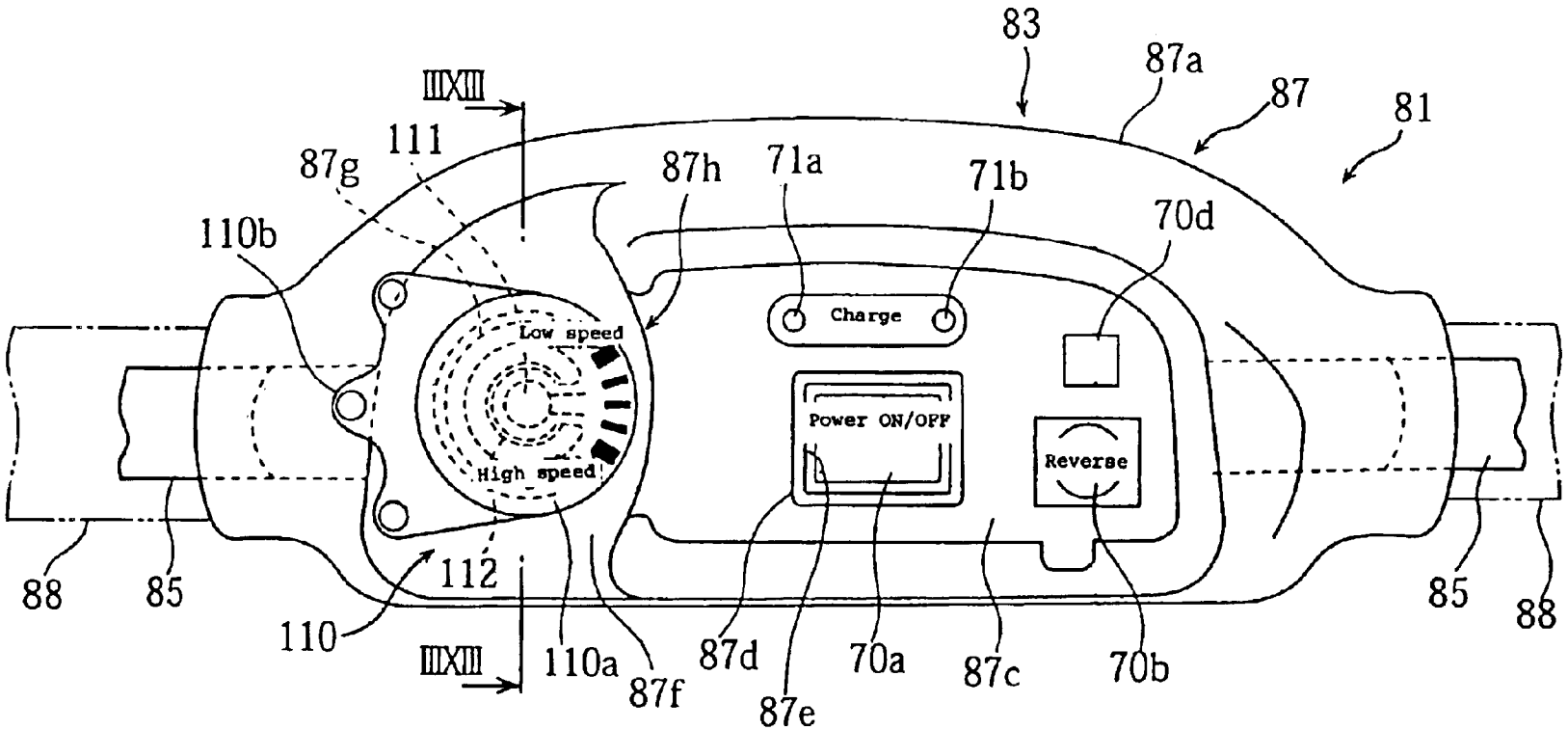

[FIG. 33]
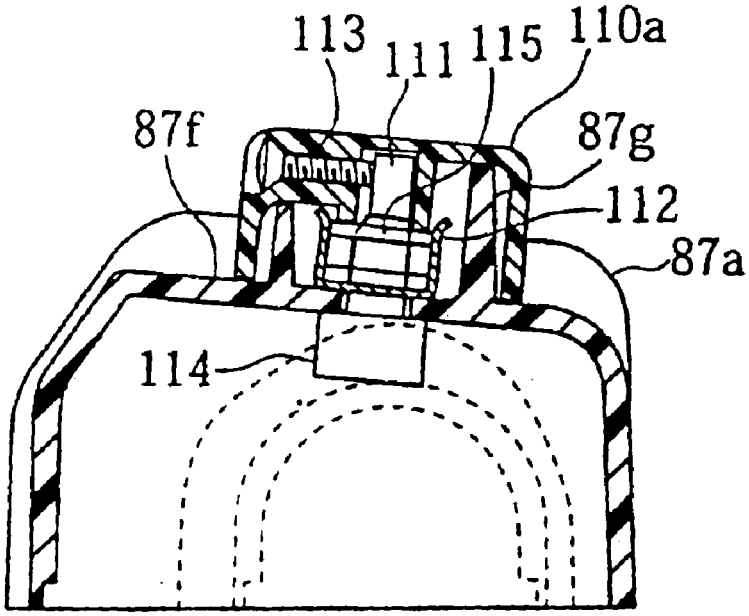

[FIG. 34]
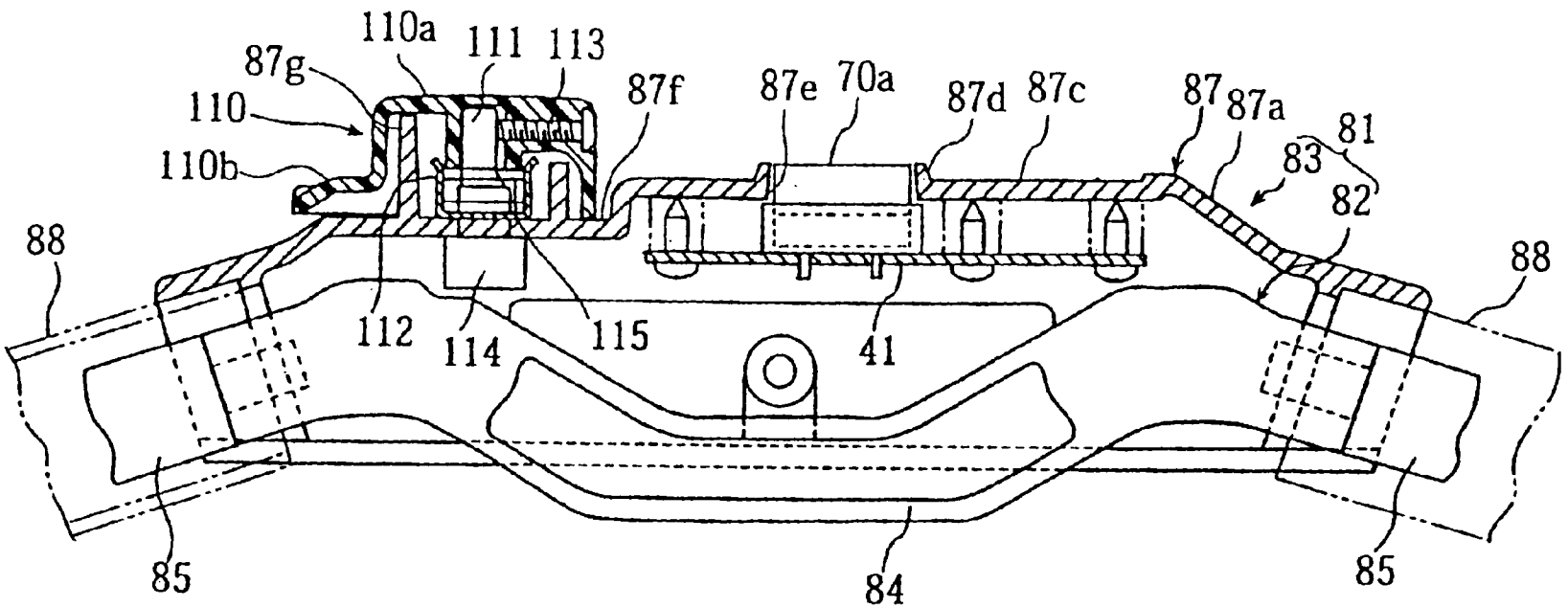

[FIG. 35]
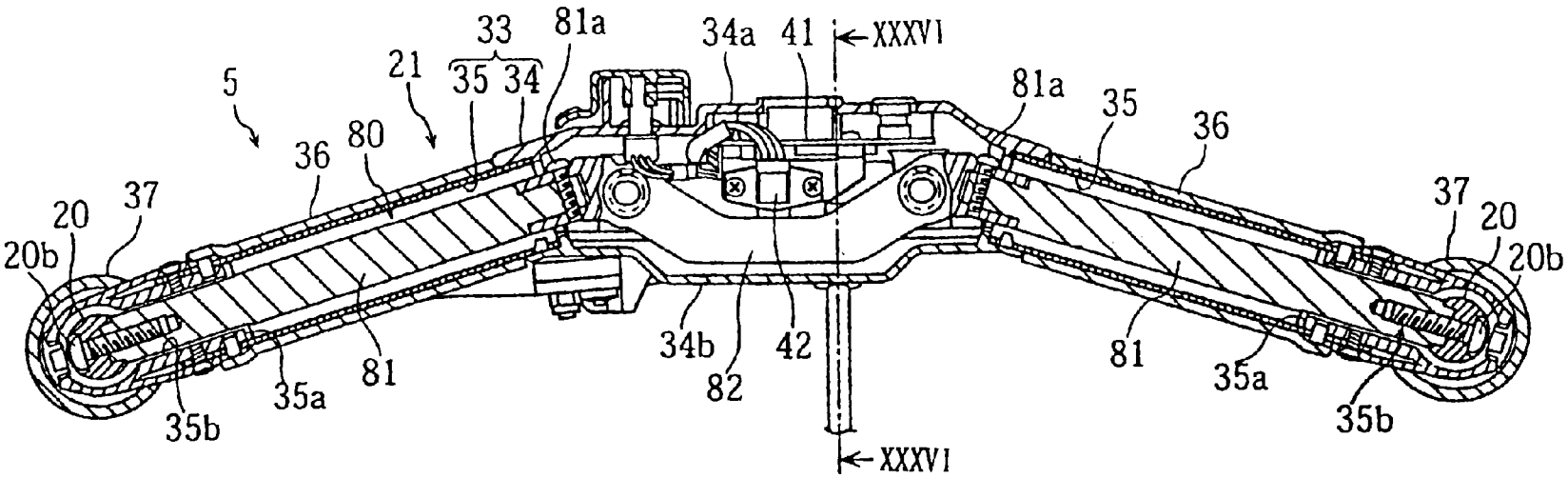

[FIG. 36]
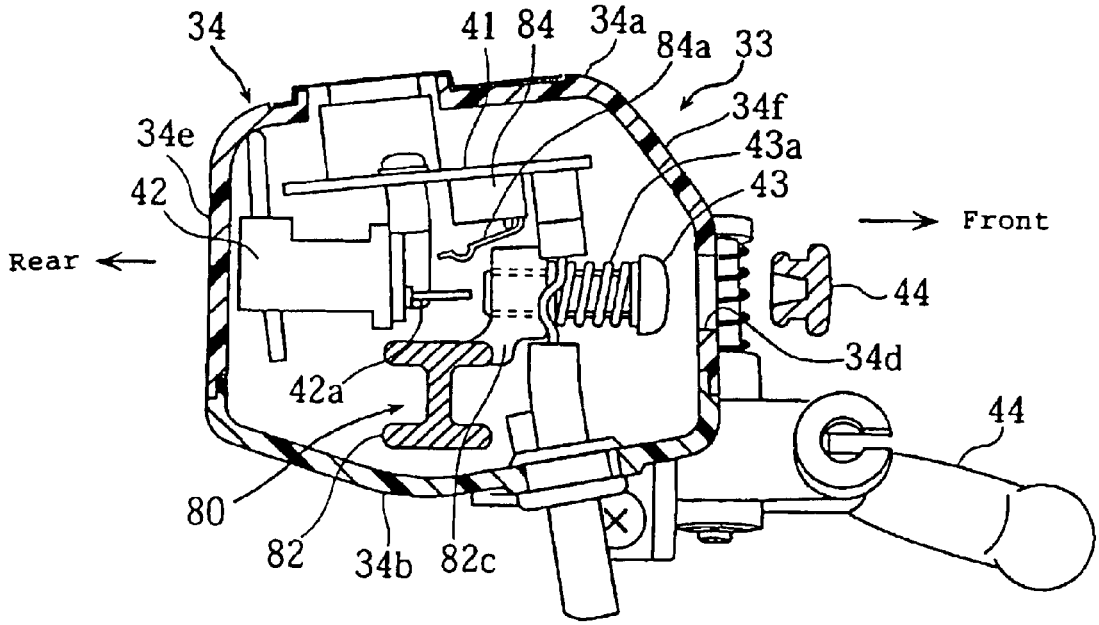

[FIG. 37]
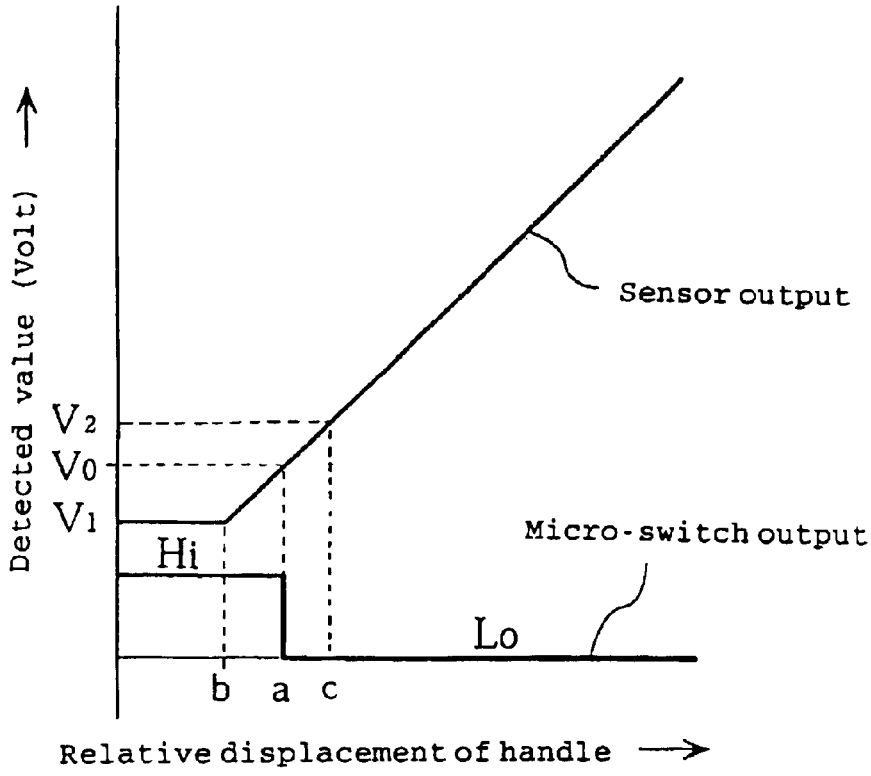

[FIG. 38]
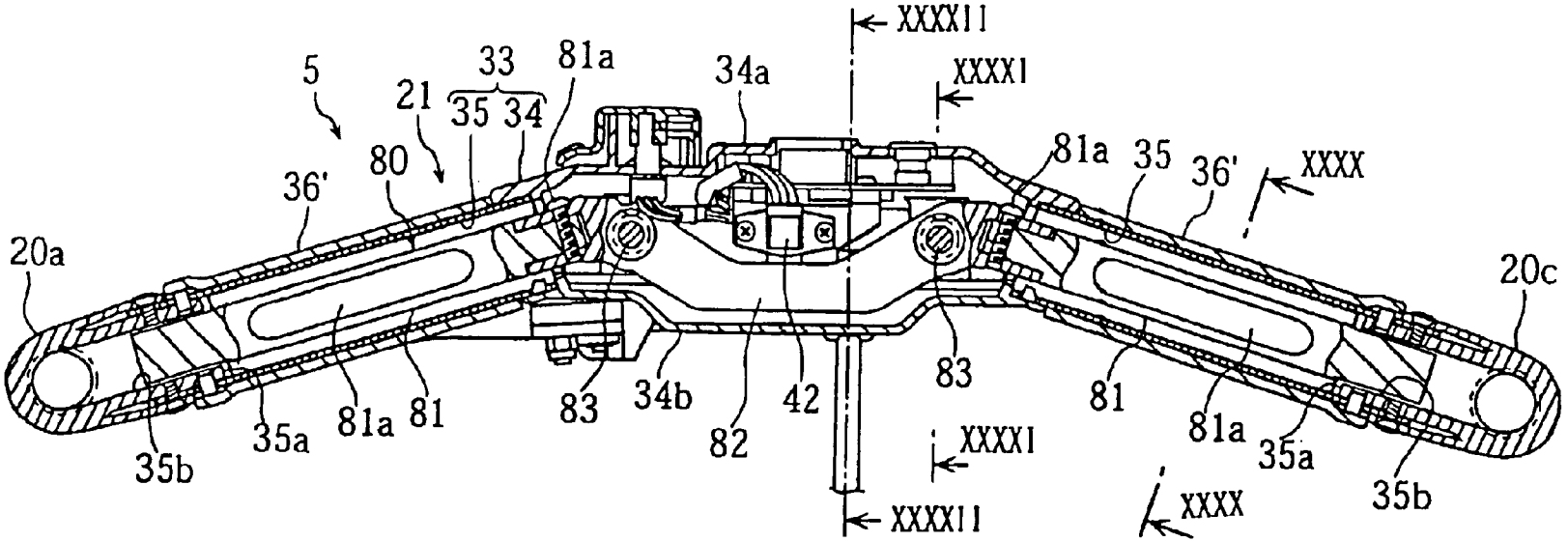

[FIG. 39]
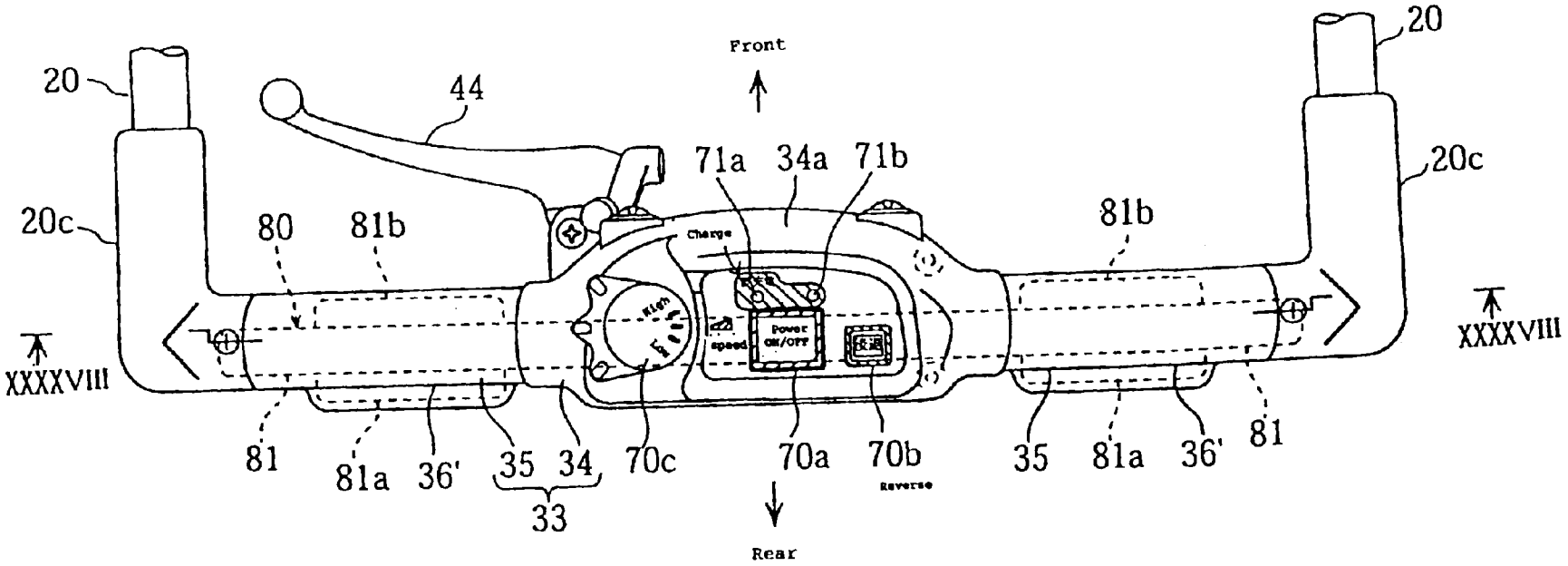

[FIG. 40]
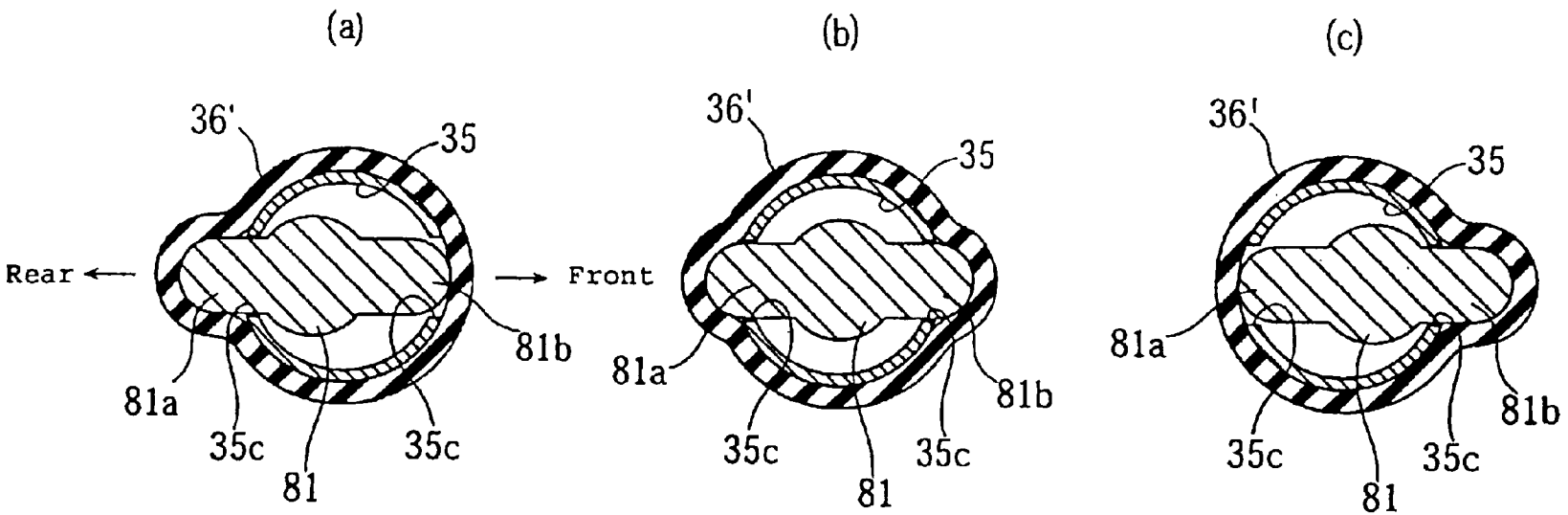

[FIG. 41]
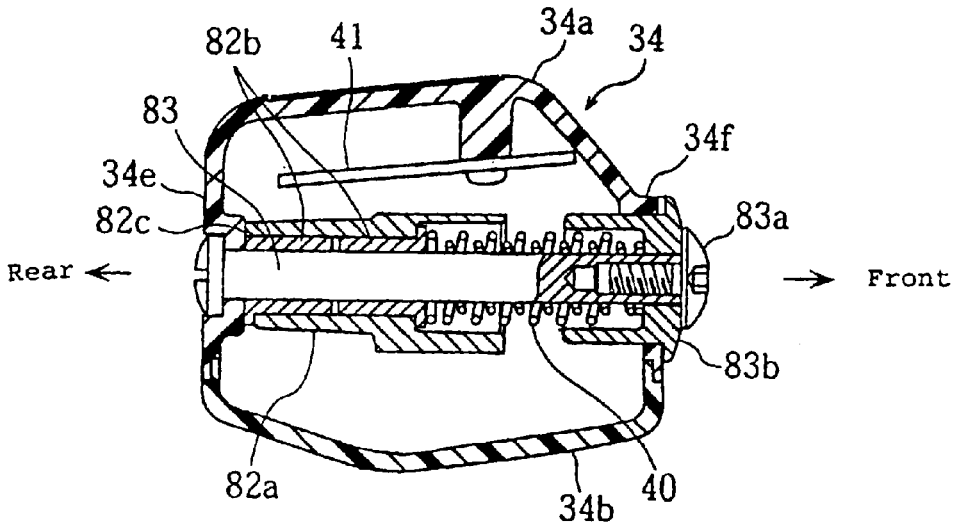
[FIG. 42]
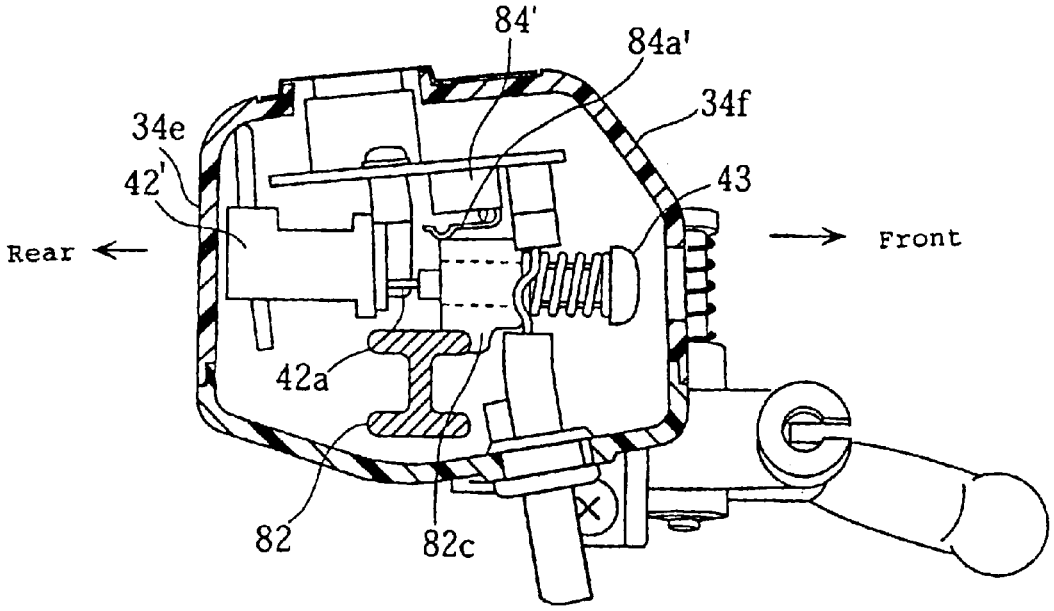

[FIG. 43]
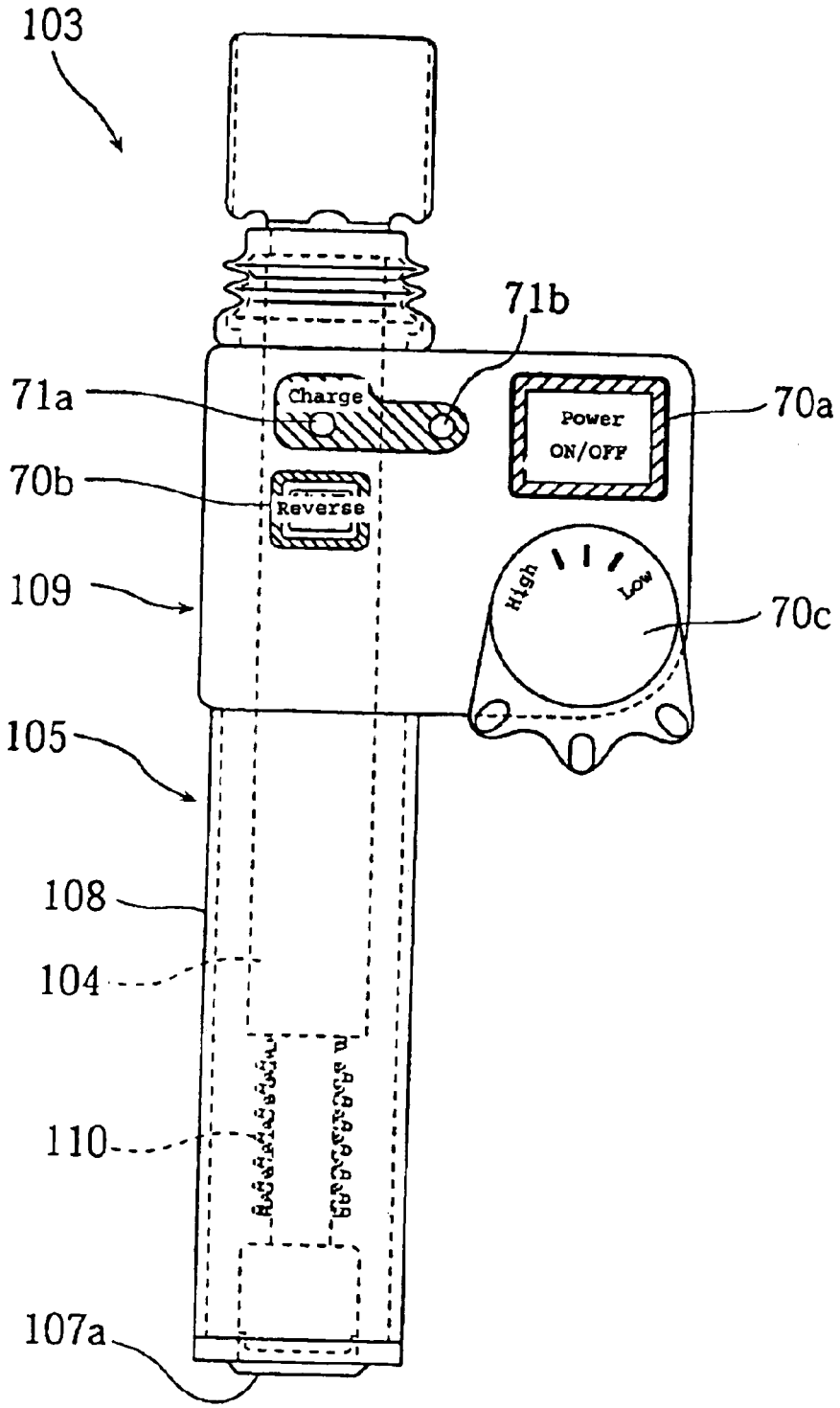

[FIG. 44]
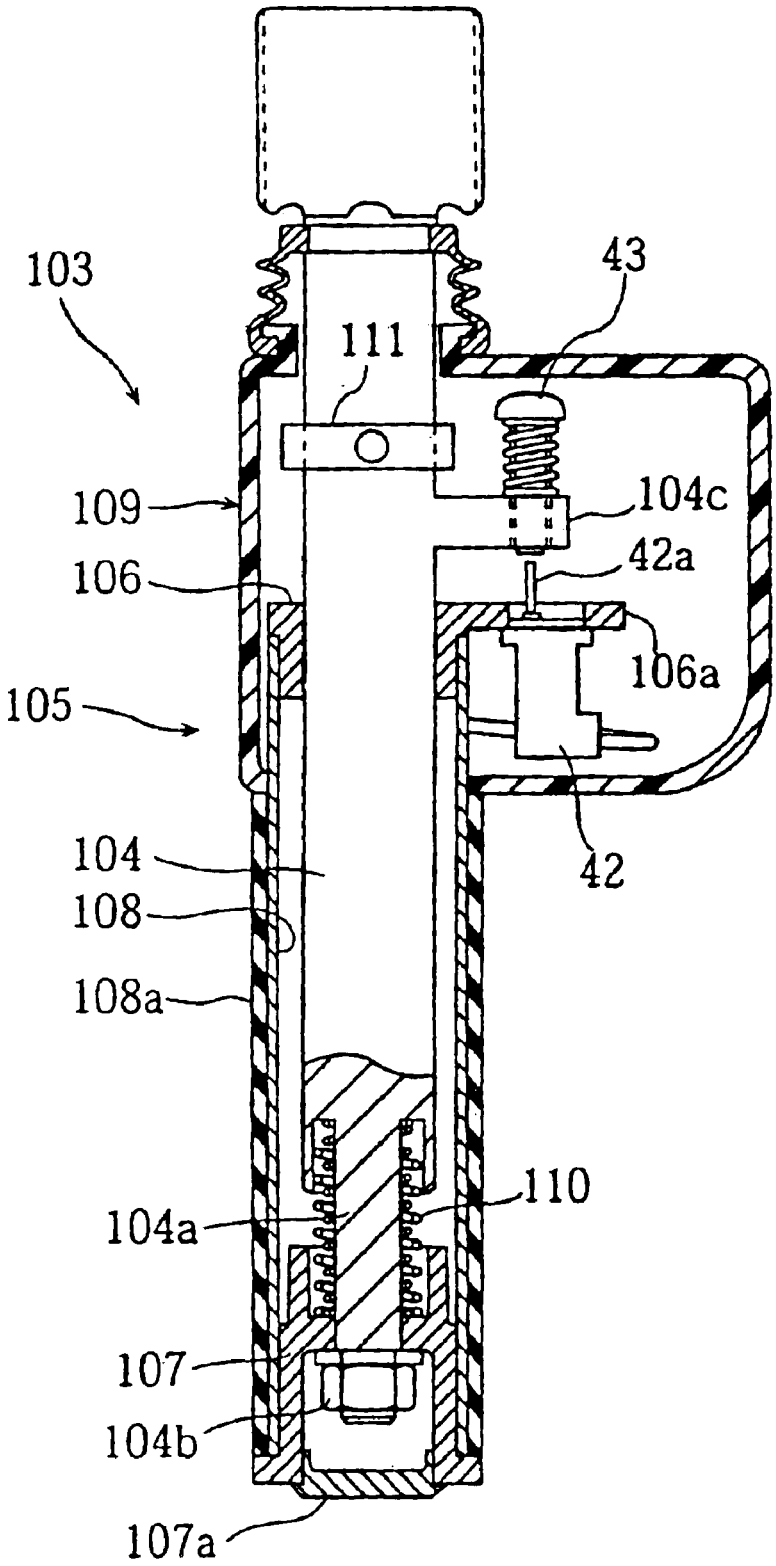

[FIG. 45]
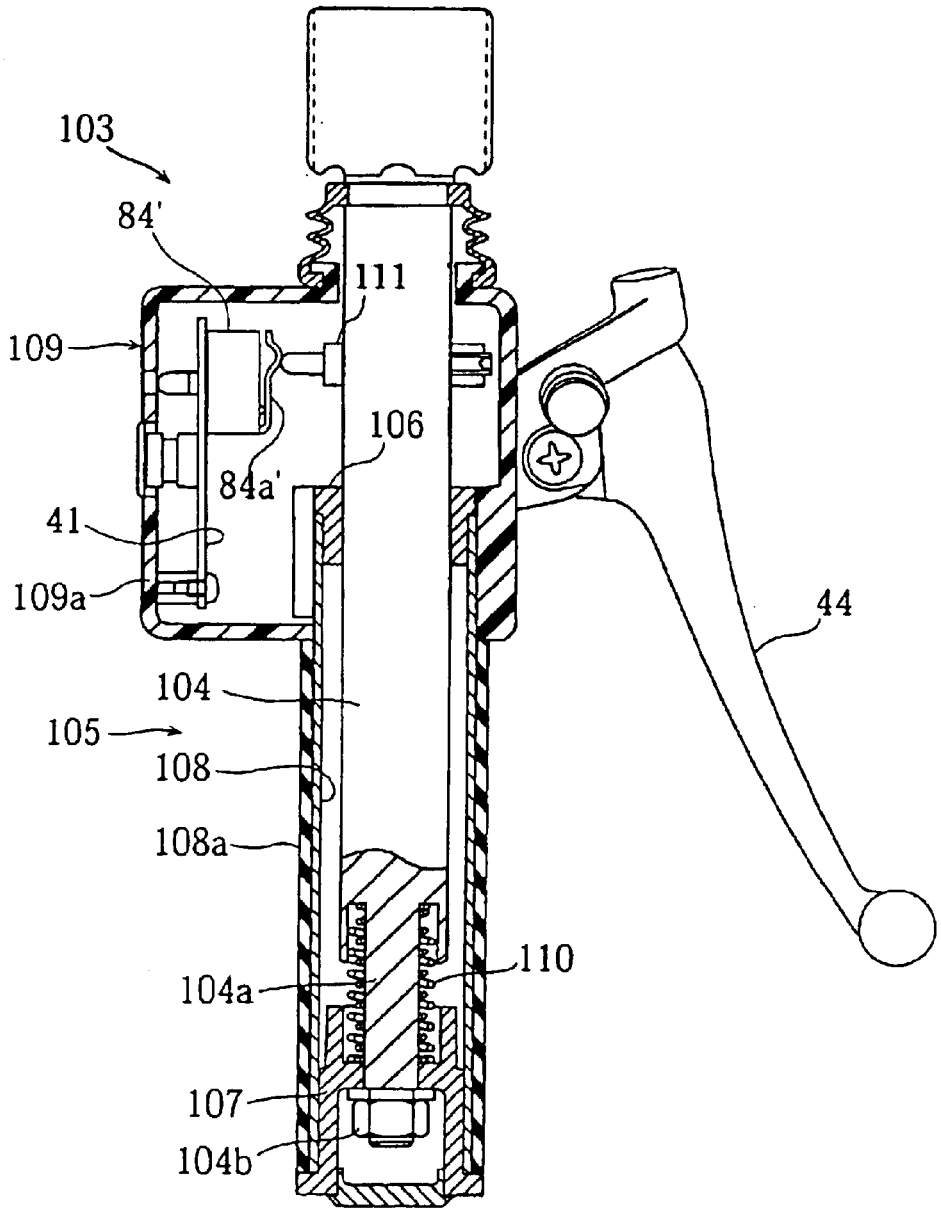

[FIG. 46]
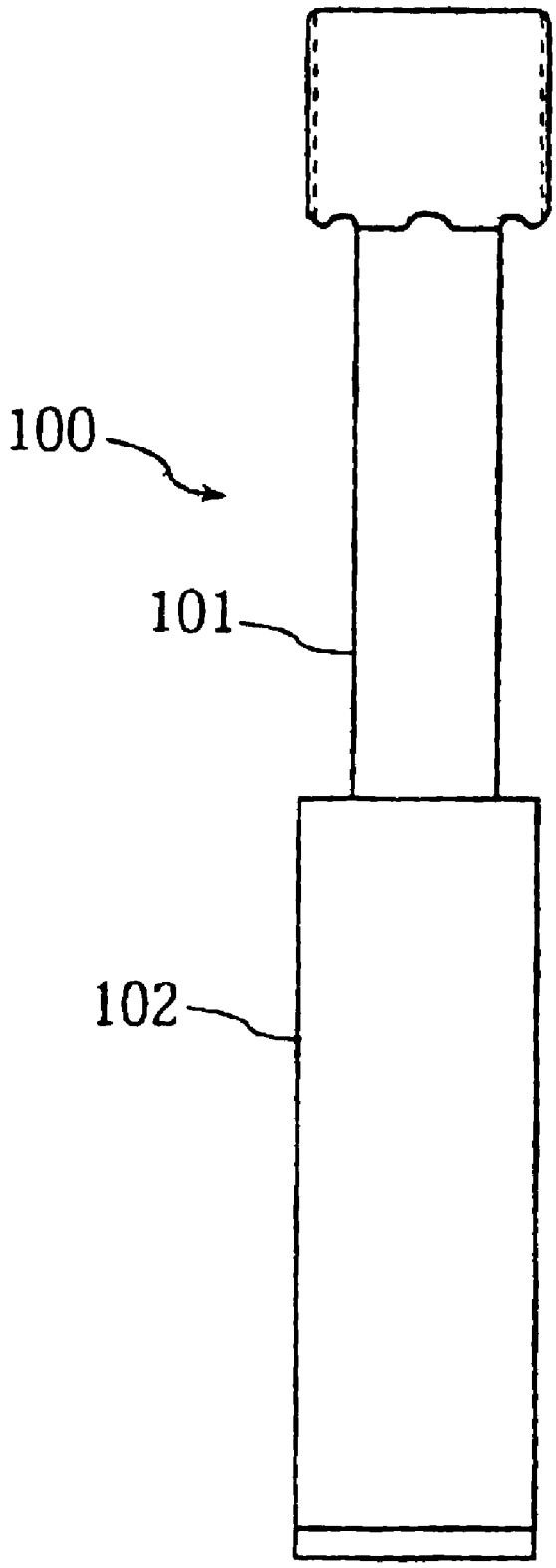

CARE TYPE ELECTRIC WHEELCHAIR

TECHNICAL FIELD

This invention relates to a nursing type of electric motor-operated wheelchair, more precisely to the one with an improved method of generating signals for controlling assisting power produced with a driving motor and with improved ease of operation by producing the assisting power through different methods depending on whether the wheelchair is to move forward or backward.

TECHNICAL BACKGROUND

In recent years, such wheelchairs have been developed as self-running type of wheelchairs provided with an electric motor operated by a rider using a joystick, and electric motor-assisted type of wheelchairs in which the rider's physical force applied to the handle rims is detected and assisted with an electric driving motor.

Nursing type of wheelchairs pushed by a nursing person from behind has also been conventionally used. A type of wheelchair has also been proposed in which the above-mentioned nursing type of wheelchair is provided with an electric motor, and the operational force applied by the nursing person to the nursing-purpose handle is detected to output assisting power commensurate with the operational force (JP-A-6-304207).

In the above-described nursing type of wheelchair, the operational force detection and the drive are performed independently on right and left wheels. Therefore, it requires plural sensors and so is disadvantageous in costs. Moreover, since the operational force is detected independently on right and left sides, the nursing person is obliged to use both hands for operation. Also, since the wheelchair cannot move straight unless the operational force is applied equally to right and left sides, awkwardness might be felt in operation. Therefore, much care is required in operation and so burden on the nursing person is a concern.

The conventional nursing type of motor-assisted wheelchair above is constituted such that the operational force is detected also in the pulling back direction of the handle to provide assisting power in the reverse direction. Therefore, when the nursing person operates the wheelchair with the front wheels lifted to negotiate a step in the so-called wheelie operation, the operational force similar to that for the reverse movement is undesirably applied and ends up in the reverse rotation of the motor. That is a problem of poor ease of operation.

The same problem of the poor ease of operation is experienced with the conventional nursing type of motor-operated wheelchair: Since a push-handle is attached to the wheelchair through a detecting section for moving the wheelchair back and forth, the operational force applied to the push-handle is detected also when the force is applied in the reverse direction to provide assisting power in the reverse direction. Therefore, when the nursing person operates the wheelchair with the front wheels lifted to negotiate a step in the so-called wheelie operation, the operational force for the reverse movement is undesirably applied and ends up in the reverse rotation of the motor.

The present invention has been made in view of the above problems to provide a nursing type of motor-operated wheelchair capable of improving ease of operation.

DISCLOSURE OF THE INVENTION

The subject of the invention according to claim 1 is a nursing type of electric motor-operated wheelchair, characterized by being provided with: a bar handle extending upward from the rear parts of right and left side frames to form a gate shape in a double member structure made up of a fixed member attached to the rear parts of the right and left side frames and an external member disposed along at least upper side portion of the fixed member; a detecting means interposed between the fixed member and the external member to detect control information based on the external force applied to the external member; and a control means for controlling a driving motor to produce assisting power commensurate with the detected control information.

The invention according to claim 2 is based on the invention of claim 1, characterized in that the bar handle is formed in a double structure made up of a fixed member of a gate shape, attached to the rear parts of the right and left side frames and a movable member disposed for relative displacement along at least upper side portion of the fixed member, a displacement detecting means is disposed to detect relative displacement as the control information between the fixed member and the movable member, and a control means is provided to control a driving motor to produce assisting power commensurate with the detected displacement.

The invention according to claim 3 is based on the invention of claim 2, characterized in that the displacement detecting means is disposed in the center, with respect to the vehicle width, of at least one of the fixed member and the movable member, and guides are provided on right and left sides of the displacement detecting means to restrict up and down movements and to permit forward and reverse movements of the movable member.

The invention according to claim 4 is based on the invention of claim 2 or 3, characterized in that the displacement detecting means is disposed in the center, with respect to the vehicle width, of at least one of the fixed member and the movable member, and grip members are provided on right and left sides of the movable member.

The invention according to claim 5 is based on the invention of claim 4, characterized in that the grip members attached to the movable member are positioned symmetrically apart from the longitudinal centerline of the vehicle and sloping obliquely up inward to the center in the vehicle width direction from right and left ends.

The invention according to claim 6 is based on the invention of one of claims 2 to 5, characterized in that the assist power controlling means controls the driving motor to move forward according to the magnitude of the relative displacement between the fixed member and the movable member obtained by pressing the upper side portion of the bar handle, and controls the driving motor to move backward when a separately provided first operator is turned on.

The invention according to claim 7 is based on the invention of one of claims 2 to 5, characterized in that the assist power controlling means controls the driving motor to move forward or backward according to the magnitude of the relative displacement between the fixed member and the movable member of the bar handle, and controls the driving motor to stop irrespective of the value detected with the displacement detecting means when a separately provided second operator is turned on.

The invention according to claim 8 is based on the invention of claim 6 or 7, characterized in that operators, including a reverse switch, a power switch, and a speed regulation device, etc. and displays, including a power display, a display for indicating the necessity of charging, an anomaly display, etc. are collectively disposed in the center, with respect to the vehicle width, of the external member of the bar handle.

The invention according to claim 9 is based on the invention of claim 1, characterized in that a load detecting means for detecting the magnitude of the load, as the control information, applied to the external member is disposed between the fixed member and the external member, and a control means is provided to control the driving motor so as to obtain assist power commensurate with the detected load.

The invention according to claim 10 is based on the invention of claim 9, characterized in that a magnetostriction sensor for detecting the load and a magnetostriction sensor for compensating the output from the load-detecting magnetostriction sensor are provided.

The invention according to claim 11 is based on the invention of claim 10, characterized in that the load-detecting magnetostriction sensor and the output-compensating magnetostriction sensor are disposed to face each other and a damping member is interposed between the two sensors.

The invention according to claim 12 is based on the invention of claim 9 or 10, characterized in that a load transmitting member for transmitting load to the load-detecting magnetostriction sensor is attached to the external member in such a manner that its position relative to the load-detecting magnetostriction sensor may be adjusted.

The invention according to claim 13 is based on the invention of claim 12, characterized in that an adjusting means that lights up or goes out depending on the relative positions of the load transmitting member and the load-detecting magnetostriction sensor is provided.

The invention according to claim 14 is based on the invention of claim 1, characterized in that the detecting means outputs control information based on the external force acting on the external member in horizontal or slightly down forward direction.

The invention according to claim 15 is based on the invention of claim 1, characterized in that the external member is provided with a handle cover disposed in the center of vehicle width, and right and left grip portions extending right and left from the handle cover, the top surface of the handle cover is formed to be an operation panel portion for placing various switches, on one side in the vehicle width direction of the handle cover's top surface is step-down-formed a rotary switch placing portion to be lower than the operation panel portion, a rotary switch is disposed rotatably in the rotary switch placing portion, and the rotary switch is provided with operation tongue portions projecting toward the grip member.

The invention according to claim 16 is based an the invention of claim 1, characterized in that the external member is provided with a handle cover disposed in the vehicle width center, and right and left grip members extending right and left from the handle cover, the top surface of the handle cover is formed to be an operation panel portion for placing various switches, a push switch projecting upward is disposed in a switch hole formed in the operation panel portion such that it projects upward from the top surface of the operation panel portion, and a switch circumferential wall is formed on the circumferential edge of the switch hole so as to surround the push switch and approximately flush with the top surface of the push switch.

The subject of the invention according to claim 17 is a nursing type of electric motor-operated wheelchair provided with a push handle for nursing, attached to the body of the wheelchair propelled as driven with a motor, characterized by being provided with: a human force detecting means for detecting human force when the push handle is pushed forward; an operator for propelling the vehicle body backward; and a motor control means for driving the motor forward according to the detected value coming from the human force detecting means and for driving the motor backward when the operator is turned on.

The subject of the invention according to claim 18 is a nursing type of electric motor-operated wheelchair provided with a push handle for nursing, attached to the body of the wheelchair propelled as driven with a motor, characterized by being provided with: a human force detecting means for detecting human force from relative movement amount when the push handle is pushed forward; a zero point detecting means for outputting a zero point signal when the relative movement amount of the push handle is a specified value; and a motor control means for controlling the motor using a reference value which is the value detected with the human force detecting means when the zero point signal is outputted.

The invention according to claim 19 is based on the invention of claim 18, characterized in that the motor control means controls the motor according to a first and a second insensible zones, with the first insensible zone defined to be one in which the relative movement amount of the push handle is smaller than the above specified movement amount, and with the second insensible zone defined to be one ranging from the above specified movement amount to an upper limit of an insensible zone which is greater than the specified movement amount.

The invention according to claim 20 is based on the invention of claim 19, characterized in that the motor control means drives the motor forward according to the value detected with the human force detecting means when the detected value is beyond the second insensible zone, makes the output of the motor zero when the detected value is in the second insensible zone, and causes the motor to function as a generator brake when the detected value is in the first insensible zone.

The invention according to claim 21 is based on the invention of one of claims 17 to 20, characterized in that, the push handle is made up of right and left leg portions secured to the right and left frames of the vehicle body and extending upward and an operating section interconnecting the upper ends of the right and left leg portions, a movable member capable of making back-and-forth relative movement is disposed in the operating section, the movable member is adapted to be capable of projecting and retracting back and forth through slits formed in the operating section, and the human force detecting means detects the human force as the movable member moves back and forth.

The invention according to claim 22 is based on the invention of claim 21, characterized in that right and left movable members are disposed in the right and left grip members, the right and left movable members are interconnected through a connecting member, and the human force detecting means detects the relative movement amount of nearly the central portion of the connecting member.

The invention according to claim 23 is based on the invention of claim 17 or 18, characterized in that the push handles are made up of right and left leg portions secured to the right and left frames of the vehicle body and extending upward and grips attached to the top end portions of the respective leg portions, at least one of the right and left grips is made capable of making relative back-and-forth movement, and the human force detecting means detects the human force from the relative movement amount of the movable grip.

BRIEF DESCRIPTION OF THE INVENTION

FIG. 1 is a left side view of a nursing-type of electric motor-operated wheelchair as an embodiment of the invention.

FIG. 2 is a back view of the wheelchair, as shown in FIG. 1.

FIG. 3 is a bottom view of the wheelchair, as shown in FIG. 1.

FIG. 4 is a left side view of the footrest portion of the wheelchair, as shown in FIG. 1.

FIG. 5 is a plan view of the footrest.

FIG. 6 is a left side view of the footrest.

FIG. 7 is a right side view of the footrest.

FIG. 8 is a sectional view along the line VIII—VIII in FIG. 6.

FIG. 9 is a sectional view along the line IX—IX in FIG. 4.

FIG. 10 is a sectional view along the line X—X in FIG. 4.

FIG. 11 is a sectional view along the line XI—XI in FIG. 4.

FIG. 12 is a sectional view along the line XII—XII in FIG. 4.

FIG. 13 is a front view in section of a bar handle of the wheelchair.

FIG. 14 is a sectional front view of a bar handle attaching-removing mechanism of the wheelchair.

FIG. 15 is a sectional front view of a lock mechanism of an extension-retraction mechanism of the wheelchair.

FIG. 16 is a sectional view along the line XVI—XVI in FIG. 15.

FIG. 17 is a sectional view along the line XVII—XVII in FIG. 15.

FIG. 18 is a sectional view along the line XVIII—XVIII in FIG. 14.

FIG. 19 is a front view of the lower support portion of the armrest of the wheelchair.

FIG. 20 is a sectional view along the line XX—XX in FIG. 13.

FIG. 21 is a sectional view along the line XXI—XXI in FIG. 13.

FIG. 22 is a sectional front view of the rear wheel and the drive unit of the wheelchair.

FIG. 23 is a schematic view of the planetary gear mechanism of the above drive unit.

FIG. 24 is a left side view of the wheelchair in the folded state.

FIG. 25 is a back view of the wheelchair in the folded state.

FIG. 26 is a plan view of the wheelchair in the folded state.

FIG. 27 is a sectional front view of the operating section of the bar handle as the second embodiment.

FIG. 28 is a sectional view along the line XXVIII—XXVIII in FIG. 27.

FIG. 29 is a sectional plan view of the operating section of the second embodiment.

FIG. 30 is a sectional view along the line XXX—XXX in FIG. 29.

FIG. 31 is a front view of a sensor holding cap in the operating section of the second embodiment.

FIG. 32 is a plan view of the operation panel portion for explaining the third embodiment of the invention according to claims 15 and 16.

FIG. 33 is a sectional view along the line XXXIII—XXXIII in FIG. 32.

FIG. 34 is a sectional front view of the operation panel portion of the third embodiment.

FIG. 35 is a sectional front view of a push handle of the fourth embodiment.

FIG. 36 is a sectional side view of the push handle as seen along the line XXXVI—XXXVI in FIG. 35.

FIG. 37 is a characteristic graph, showing the relation between the bar handle's relative movement amount and the outputs from a microswitch and a sensor.

FIG. 38 is a sectional front view of a push handle of the fifth embodiment.

FIG. 39 is a plan view of the above push handle.

FIG. 40 is a sectional side view, showing the movement of the movable member of the push handle as seen along the line XXXX—XXXX in FIG. 38.

FIG. 41 is a sectional side view of the push handle as seen along the line XXXXI—XXXXI in FIG. 38.

FIG. 42 is a sectional side view of the push handle as seen along the line XXXXII—XXXXII in FIG. 38.

FIG. 43 is a plan view of the push handle of the sixth embodiment.

FIG. 44 is a sectional plan view of the push handle of the sixth embodiment.

FIG. 45 is a sectional side view of the above push handle of the sixth embodiment.

FIG. 46 is a plan view of the above push handle of the sixth embodiment.

BEST FORMS OF EMBODYING THE INVENTION

Embodiments of the invention will be hereinafter described in reference to appended drawings.

FIGS. 1 to 26 are drawings for explaining the first embodiment of the invention. The drawings show; a nursing type of wheelchair 1 of the first embodiment. To roughly describe the constitution of the wheelchair 1, its frame 2 comprises right and left side frames 3, 3 interconnected, to be foldable, through a connecting frame 4. A gate-shaped bar handle 5 is detachably attached to span the rear portions of the right and left side frames 3, 3. Footrests 6, together with foot brackets 12, are detachably attached to the front portions of the right and left side frames 3, 3.

The constitution of the right and left side frames 3, 3 may be roughly described as follows: The frames 3, 3 are positioned symmetrically on the right and left of the wheelchair. As seen in the side view, an L-shaped seat pipe 7 has a nearly horizontal side stretch portion 7*a* and a vertical stretch portion 7*b* curved downward from the front end of the side stretch portion 7*a*. A vertically extending back pipe 8 is attached to the rear end of the side stretch portion 7*a*. The lower end of the vertical stretch portion 7*b* and the lower part of the back pipe 8 are interconnected through a reinforcing pipe 9 extending obliquely up rearward and having an elliptic cross section with its major axis vertical. The portion between the side stretch portion 7*a* and the vertical stretch portion 7*b* is curved in an arcuate shape to be easily gripped by hand when the wheelchair is in the folded state.

Brackets 7*c*, 7*c* are attached in spaced positions on the top surface of the side stretch portion 7*a*. A seat anchor 10 is disposed on the top surfaces of the brackets 7*c,* 7*c*. A seat cloth 11 is stretched between the right and left seat anchors 10, 10, with the right and left edges of the seat portion 11*a* of the seat cloth 11 being secured and supported with the right and left seat anchors 10, 10. The backrest portion 11*b* of the seat cloth 11 is stretched between the upper parts 8*a,* 8*a* of the back pipes 8, with the right and left upper edges of the backrest portion 11*b* of the seat cloth 11 being stretched between the right and left upper parts 8*a,* 8*a* of the back pipes 8, 8.

The Seat anchor 10 is disposed in over-and-under relation on the side stretch portion 7*a*. The right and left frames 3, 3 are interconnected to be foldable through the connecting frame 4. To describe it more concretely, support pipes 4*a,* 4*a* of the connecting frame 4 are pivoted on the inside surfaces of the right and left reinforcing pipes 9 by means of support bolts inserted into brackets 9*a,* 9*a*. To the respective support pipes 4*a,* 4*a* are secured the lower ends of two sets of connecting links 4*b;* one front set of connecting links 4*b,* 4*b* and the other rear set of connecting links 4*b*, 4*b*. The upper ends of the connecting links 4*b,* 4*b* are secured to the seat anchors 10, 10 on respectively opposite sides. The front and rear sets of connecting links 4*b,* 4*b* are rotatably interconnected through center pins 4*c*.

A portion above the center pin 4*c* of the connecting link 4*b* and a bracket 7*d* secured to the side stretch portion 7*a* of the seat pipe 7 are pivot-interconnected through an intermediate link 4*d,* on either side. Thus, the wheelchair 1 is made foldable in the vehicle width-reducing direction. The intermediate links 4*d* serve to hold the wheelchair in the state for use.

A holding loop 69 is attached to the center pin 4*c* of the connecting links 4*b,* 4*b* of the front side. The holding loop 69 is made of an endless string such as braided one and, as described later, serves to hold the leg portion 20 of the bar handle 5 when the bar handle 5 is removed and stowed in the folded wheelchair.

In the present embodiment as described above, the lower end of the vertical stretch portion 7*b* and the lower part 8*b* of the back pipe 8 are interconnected through the reinforcing pipe 9 extending obliquely up rearward and having a vertically elongate elliptic cross section. Because the seat pipe 7, the back pipe 8, and the reinforcing pipe 9 form a roughly triangular shape as seen in side view, and because the reinforcing pipe 9 itself has the vertically elongate elliptic cross section which has a large section modulus against bending loads, rigidity of the frame may be increased without increasing much in weight.

Moreover, since the front portion of the seat pipe 7 and the back pipe 8 are interconnected through the reinforcing pipe 9 extending obliquely up rearward and having a vertically elongate elliptic cross section with a greater width than other members as seen in side view, the reinforcing pipe 9 becomes an accent in appearance to enhance designing effect.

A caster attaching pipe 14 is secured through a supporting block 13 to the vertical stretch portion 7*b* of the right or left seat pipe 7 in a position outside and parallel to the vertical stretch portion 7*b*. A bifurcate caster bracket 16 is supported, with the lower end portion of the caster attaching pipe 14, to be rotatable about the axis of the caster attaching pipe 14. A caster (front wheel) 15 is pivoted with the caster bracket 16 (on either side).

The supporting block 13 is made up of an outer block 13*a* for passing through and securing the caster attaching pipe 14, and two-piece inner blocks 13*b* and 13*c* which squeeze and secure the vertical stretch portion 7*b*. The inner blocks 13*b* and 13*c* are tightened and secured with a bolt 13*d* passing through the vertical stretch portion 7*b*. The outer block 13*a* is tightened and secured to the inner blocks 13*b* and 13*c* with bolts 13*e*.

A footrest 6 is supported with a foot bracket 12 on the caster attaching pipe 14. The footrest 6 is constituted with a U-shape pipe 6*a* to which a plastic-made footplate 6*b* is secured. A support pipe 12*a* passes through a support hole 6*d* in a base portion 6*c* of the footplate 6*b* to support the footplate 6*b* for movement between a horizontal position for use and an upright position. When the footrest 6 is turned to the use position, a stopper 6*e* contacts the lower end of the main pipe 12*b* supporting the support pipe 12*a* to hold the footrest 6 in the use position.

A plate spring 17 is inserted through a spring insertion hole 6*f* and disposed on the central top surface of the support hole 6*d*. The plate spring 17 is in contact with the top surface of the support pipe 12*a* to force it downward. Thus, the support pipe 12*a* is constantly in pressing contact with the lower surface of the support hole 6*d* to prevent the footrest 6 from rattling.

The foot bracket 12 is roughly in an L shape made up of an oblique member 12*c* to which the main pipe 12*b,* extending obliquely up rearward toward the upper end of the caster attaching pipe 14, is coaxially joined using a bolt 12*h,* and a lower stretch member 12*d* through which the lower part of the oblique member 12*c* is passed and secured. A wedge 12*i* is formed at the top end of the main pipe 12*b* to increase the joining force when the bolt 12*h* is tightened. The lower stretch member 12*d* is shaped and disposed to look like, as seen in side view, the direct extension of the reinforcing pipe 9 to improve appearance.

A plastic-made rotary pin 12*e* provided in the top end portion of the oblique member 12*c* is inserted into the caster attaching pipe 14 and serves as a rotary shaft. A contact recess portion 12*f* formed in the rear end of the lower stretch member 12*d* is made to be in sliding contact with the front face of the caster attaching pipe 14. Thus, both of the foot bracket 12 and the footrest 6 may be attached to or removed from the frame.

A lock lever 18 is rotatably attached to a through hole 12*g* of the lower stretch member 12*d*. An engage-stop claw 18*a* of the fore-end of the lock lever 18 is adapted to engage with an engage-stop rod 14*a* when the foot rest 6 is rotated to the use position to lock the footrest 6 in the use position. The engage-stop rod 14*a* is disposed parallel to the caster attaching pipe 14, with its top end bent in the horizontal direction, made to pass through the caster attaching pipe 14, and is tightened with a nut. The lower end of the engage-stop rod 14*a* is secured with a nut to a bracket 14*b* weld-secured to the lower end of the caster attaching pipe 14.

The lock lever 18 is forced with an urging spring 19*a* in the locking direction through a pressing pin 19*b*. When the lock lever 18 is turned outward by hand, the footrest 6 may be unlocked together with the bracket 12, may be rotated outward and taken out upward.

The handle bar 5 is made up of right and left leg portions 20, 20 made of round pipe, and an operating section 21 interconnecting the top ends of the leg portions to form a gate shape. The operating section 21 extends from the right or left end toward the center of the vehicle width obliquely upward to generally form an obtuse-angled, inverted V-shape. The bar handle 5 is made adjustable in height and may be attached to or removed from the frame 2 as required. The lower ends of the right and left leg portions 20 are adapted to be attached to or removed from the top ends of inner cylinders 23 of telescopic extension-retraction mechanism 22 attached to the right and left frames 3, 3. The telescopic mechanism 22 is constituted in a straight shape with an outer cylinder 24 secured to the side frame 3 and with an inner cylinder 23 inserted for extension and retraction into the outer cylinder 24 so as to be fixed at a specified extended or retracted length.

The lower end of the outer cylinder 24 is secured to the vicinity of the rear end of the side stretch portion 7*a* of the seat pipe 7 through a bracket 24*a,* while its upper end is secured to the middle portion of the back pipe 8 through a lock mechanism 25, so as to form, as seen from the rear, a right-angled triangle with the seat pipe 7, the back pipe 8, and the outer cylinder 24 which is the oblique side. Thus, the outer cylinder 24 serves as a reinforcement member of the vehicle body frame.

The lock mechanism 25 is constituted with a lock block 26 fitted over the outer cylinder 24 and secured to the back pipe 8 using a bolt 28, and with a lock lever 27 attached rotatably to the lock block 26 through a pivot pin 27*a*. A cam 27*b* is formed around the pivot pin 27*a* of the lock lever 27. A holder 27*c* is interposed between the cam 27*b* and the inner cylinder 23. Engagement grooves 23*a* at specified spacing are formed in the lower outside circumferential surface of the inner cylinder 23, so that a ball 26*a* urged with a spring 26*d* may engage with the engagement groove 23*a*. Thus, the telescopic mechanism 22 is made rattle-free, and at the same time gives click stop feeling when operated to extend or retract.

When the telescopic mechanism 22 is extended to a required length and the lock lever 27 is rotated to the position shown in solid lines in FIG. 17, the cam 27*b* presses the holder 27*c,* so that the inner cylinder 23, or the bar handle 5, is fixed to an intended height in position. When the lock lever 27 is rotated by 90 degrees counterclockwise from the position shown with the solid lines to the position shown with the phantom lines in FIG. 17, the bar handle is unlocked, so that the inner cylinder 23 may be adjusted in height.

An attaching-removing mechanism 29 is provided between the lower end of the leg portion 20 of the bar handle 5 and the upper end of the inner cylinder 23 of the telescopic mechanism 22. The attaching-removing mechanism 29 is constituted that a joint rod 23*c* is screwed into a boss member 23*b* secured by welding or the like method to the upper opening of the inner cylinder 23 and secured with a nut 23*d*. A handle cover 30 is secured to the lower end of the leg portion 20. A lock lever 31 is attached, to be rotatable about a rotary pin 31*a,* to the handle cover 30.

A cam 31*b* formed around the rotary pin of the lock lever 31 is adapted to come into direct contact with the joint rod 23*c*. An engage-stop groove 23*d* is cut around the outside cylindrical surface of the joint rod 23*c,* so that a ball 30*a* disposed in the handle cover 30 is urged with a spring 30*b* to engage with. Thus, rattling when attaching and removing the bar handle 5 is absorbed, and distinct (click stop) feeling is provided.

When the lock lever 31 is turned to the position shown with solid lines in FIG. 18, the cam 31*b* comes into pressing contact with the joint rod 23*c,* so that the bar handle 5 is attached to the frame 2. When the lock lever 31 is rotated by 90 degrees clockwise from the position shown with the solid lines to the position shown with the phantom lines in FIG. 18, the lock is unlocked, so that the bar handle 5 may be removed.

The operating section 21 of the bar handle 5 is constituted with combination of an inner pipe (securing section) 32 and a set of outer members (movable sections) 33 to permit relative displacement which is electrically converted with a signal converter and detected. The inner pipe 32 is made of a single metallic pipe with a slightly elevated central portion and right and left side portions extending outward from the central portion gradually sloping down. To each of the right and left ends of the inner pipe 32 is attached the leg portion 20, 20 through a bar handle bracket 20*a* and securely tightened with a bolt 20*b*.

The outer member 33 is constituted with; a handle cover 34 which covers, while leaving a gap, the central portion, with respect to the vehicle width, of the inner pipe 32, and right and left pipes 35, 35, which are supported respectively with bearing (guiding) members 35*a* provided on both right and left ends of the handle cover 34 so as to cover, while leaving a gap, the right and left portions of the inner pipe 32.

The bearing member 35*a* is formed with a guide hole 35*b* of an elliptic cross section that is elongate in forward and rearward directions. In the guide hole 35*b* is inserted the inner pipe 32. In this way, the outer member 33 is movable in the (front-and-rear) direction of the major axis of the elliptic cross section of the guide hole 35*b* but immovable in the minor axis direction of the cross section of the guide hole 35*b*.

Grips 36, 36 made of rubber or the like are fitted over the right and left pipes 35, 35. As the grips 36, 36 are disposed to slope down outward, the palms of a nursing person's hands extended to grip the grips 36, 36 and to operate the bar handle 5 agree well with the sloping angle of the grips 36, 36 to facilitate the operation. Right and left bellows-shaped collars, 37, 37 are attached to surround corresponding parts connecting the right and left inner pipes 32, 32 to the right and left parts of the leg portions 20, 20.

The handle cover 34 is made up of two separate parts; an upper cover 34*a* and a lower cover 34*b,* joined together to form a single body by tightening two bolts 32*b,* one for each side. The two parts are also secured to the center side ends of the right and left pipes 35, 35, using four bolts 32*a,* two on each side.

Two guide pipes 38, 38, one for each side, extending in forward and rearward directions, are disposed in the upper cover 34*a,* spaced symmetrically on both sides of the vehicle's longitudinal center line. The guide pipes 38, 38 are secured to the upper cover 34*a* using bolts 38*a,* 38*a* inserted from outside the upper cover 34*a*.

Each of the guide pipes 38 supports a guide plate 39 so that its guide cylinder portions 39*a,* 39*a* can make back-and-forth, relative movement (sliding). An urging spring 40 is interposed between the inside wall of each guide cylinder portion 39*a* and the back wall 34*e* of the upper cover 34*a*. Here, a relatively large clearance is provided between the inside diameter of the cylindrical portion 39*a* and the guide pipe 38.

The guide plate 39 is provided with securing flanges 39*b* so as to straddle the inner pipe 32. The guide plate 39 is secured to the inner pipe 32 with a bolt 38*b* inserted to pass through the flanges 39*b* and the inner pipe 32, and with a nut 38*c*.

As described above, the outer member 33 is supported with the inner pipe 32 to be relatively movable only in the (back-and-forth) direction at right angles to the axis of the pipe and is urged toward the rear by means of the urging spring 40. Here, the inside surface of the forward wall 34*f* of the upper cover 34*a* contacts the front end surface of the cylindrical portion 39*a* to determine the rear end position of the outer member 33. The inner pipe 32 is supported with the elliptic-cross-sectional guide hole 35*b* of the bearing member 35*a,* so that the guide hole 35*b* permits the outer member 33 to move only in the back-and-forth directions. Also as described above, since a relatively large clearance is provided between the guide pipe 38 and the cylindrical portion 39*a,* in case for example only the right hand side grip 36 is pushed, the outer member 33 swings about the left hand side bearing member 35*a* with the right hand side pushed forward, obliquely as seen from above.

A base plate 41 for supporting electric components such as sensors is secured with bolts to the boss portions 34*c* extending downward from the ceiling inside surface of the 34*a*. A sensor 42 of direct motion type is attached to the underside of the base plate 41. The detecting needle 43*a* of the sensor 42 is directed toward an end of an adjustment bolt 43 screwed into the sensor flange portion 39*c* of the guide plate 39, so that the initial detection value may be adjusted by adjusting the screwing amount of the adjustment bolt 43. Incidentally, the reference numeral 44 stands for a plug for opening and closing the screwing amount adjustment hole 34*d* of the adjustment bolt 43.

Here, insensible zones are set in the operation starting range of the sensor 42. Setting the insensible zones is made in the following steps: An LED is provided which lights up when it is not in contact with the detecting needle 43*a* and goes out when in contact. First, the adjustment bolt 43 is screwed in from the state of the LED being lit up to the turned-off state, and screwed out slightly from the turned-off position to a lit-up position. Thus, an insensible zone is easily set in the operation starting range of the sensor 42.

Setting the insensible zone as described above makes it possible to prevent malfunction due to dimensional errors and deformation of the inner pipe 32 and outer member 33, and to perform assembly and adjustment work easily and reliably.

When the right and left grips 36, 36 of the outer member 33 are pressed, the sensor 42 makes relative forward displacement, and assisting power commensurate with the displacement is produced. At this time, if the right hand side grip 36 only for example is pressed, the outer member 33 swings to an oblique attitude, and the amount of relative displacement of the sensor 42 is smaller than when both of the right and left hand side grips 36, 36 are pressed. As a result, the assisting power at the time of turning operation is smaller than that at the time of straight movement, which means improved ease of operation.

On the upper cover 34*a* are seen; a power switch 70*a,* a reverse switch 70*b,* a speed controller 70*c,* a clutch shift switch 70*d* (for shifting clutch function, to be described later), a power display 71*a,* and a display 71*b* for indicating the necessity of charging. They are collectively mounted on the upper surface of the base plate 41.

The underside wall of the lower cover 34*b* has an integrally formed lever holder 34*g* which pivots a brake lever 44 for swinging movement about a fitting bolt 44*a*. A brake cable 45 attached to the brake lever 44 is routed, bundled together with a wire harness 46 connected to the above electric components for power supply and signal takeout within the handle cover 34, along the right hand side back pipe 8, and connected to right and left drive units 54 which will be described later. Incidentally, the above wire harness 46 may be alternatively routed through the interior of the bar handle 5.

Here, the brake cable 45 is branched to right and left brake cables 45*b,* 45*c* using a cylinder type of dividing mechanism 45*a*. The left brake cable 45*b* extends to the left along the seating portion 11*a* of the seat cloth 11 and is connected to a drum lever 45*d* of a rear wheel 49. The right brake cable 45*c* is connected to the drum lever 45*e* of the right rear wheel 49. Therefore, the right and left rear wheels are simultaneously broken when the brake lever 44 is squeezed. Incidentally, the above wire harness 46 may be alternatively routed through the interior of the bar handle 5. Here, the reference numeral 45*f* stands for a component for adjusting the lengths of the brake cables 45*b,* 45*c*.

The brake lever 44 also serves as a parking brake lever. That is, the brake lever 44 may be moved and held to the braking position to apply parking brake. To described it more in detail, the lever holder 34*g* is provided with a stepped engage-stop rod 44*d* having a large diameter portion 44*b* and a small diameter portion 44*c* to be capable of back-and-forth axial movement. The engage-stop rod 44*d* is urged with an urging spring 44*e* to a position where the small diameter portion 44*c* corresponds to the brake lever 44.

When the brake lever 44 is turned to the working position and the engage-stop rod 44*d* is pushed in so that the large diameter portion 44*b* is opposite the brake lever 44, the brake lever 44 is held to the working position to apply parking brake. When the brake lever 44 is gripped again, as the engage-stop rod 44*d* is lifted with the urging spring 44*e* and the small diameter portion 44*c* corresponds to the brake lever 44, ordinary brake may be applied.

As described above, this embodiment is arranged with the bar handle 5 made in the gate shape straddling the rear parts (rear frames) of the side frames 3 and its height is made adjustable. Therefore, the height of the bar handle 5 may be adjusted to match the nursing person, so that the wheelchair 1 is easily moved around by gripping and pushing the operating section (upper side portion) 21 of the gate shape handle.

Moreover, since the bar handle 5 is made removable, the entire wheelchair 1 may be folded without problem, although the bar handle 5 is made in the gate shape. Another point is that, since the handle accommodating section is provided on the vehicle body, the bar handle 5 removed when folding the wheelchair may be neatly accommodated, so that the bar handle 5 cannot be lost.

Steps of folding the wheelchair will be described according to FIGS. 24 to 26. To fold the wheelchair 1, first the lock handle 31 of the attaching-removing mechanism 29 is turned clockwise by 90 degrees from the position shown in FIG. 18. As this step unlocks the cam 31*b,* the leg portion 20 is pulled up to remove the bar handle 5. The footrest 6 is turned up and the connecting links 4*b,* 4*b* are turned upward about the support pipes 4*a*. By this step, the wheelchair 1 is folded up to the state in which the right and left motors 57 are in mutual contact. The bar handle 5 that has been taken out as described above is stowed in the wheelchair 1, with one leg portion 20 located in front and the other leg portion 20 in the rear. Here, the leg portion 20 on the front side is supported as suspended with the holding loop 69 while the leg portion 20 on the rear side is supported as inserted into the seat-back portion 11*b* of the seat cloth 11.

Moreover, since the brake lever 44 is attached to the bar handle 5, the bar handle 5 remains connected to the vehicle body through the brake cable 45 even if the bar handle 5 is removed. Therefore, the bar handle 5 cannot be lost when it is removed.

Here in this embodiment, since the driving motors 57, 57 of the right and left drive units 54, 54 face each other, there is a limit in reducing the folded width of the wheelchair 1.

To solve this problem, the right and left drive units 54, 54 may be constituted as shown in FIG. 25 in which the left driving motor 57 and the right driving motor 57' are formed as indicated with phantom lines in complementary shapes. Thus, the folded width of the wheelchair 1 is reduced.

Armrests 47 are attached to right and left sides of the frame 2. Each armrest 47 is made up of a leg portion 47*a* extending upward with a slight forward list, an arm portion 47*b* extending generally horizontally rearward from the top end of the leg portion 47*a,* and a cover 47*c* disposed over the arm portion 47*b.*

A support bracket 47*d* in a downward bulging arcuate shape is connected to the rear end of the arm portion 47*b.* The rear end of the support bracket 47*d* is pivoted with the lock block 26 of the telescopic extension-retraction mechanism 22 to be capable of rotation and also movable in the vehicle width direction by a specified stroke.

To put it more in detail, a support shaft 48 is inserted into the bearing hole 26*b* of the lock block 26 so as to slide in both rotary and axial directions, and the support bracket 47*d* is securely tightened to the projecting portion of the support shaft 48 by means of a nut 48*a.* Part of the support shaft 48 located inward in the vehicle width direction is positioned within an accommodation hole 26*c* formed in the lock block 26. A stop ring 48*b* is fitted to the inward end of the support shaft 48. The inward end is also provided with engage-stop grooves 48*c,* 48*d* spaced to correspond to the above-mentioned stroke. A ball 48*e* urged inward with a spring engages selectively with one of the engage-stop grooves 48*c*, 48*d.*

The armrest 47, when pulled outward in the vehicle width direction, moves outward; the stop ring 48*b* strikes against the bottom surface of the accommodation hole 26*c,* and the ball 48*e* is urged with a spring to engage with the engage-stop groove 48*c* and is held there with a click stop feeling. The armrest 47, when pushed inward in the vehicle width, moves inward; the ball 48*e* engages with the engage-stop groove 48*d* and is held there with a click stop feeling. At this time, the support shaft 48 does not project to the inside of the lock block 26.

The lower end of the leg portion 47*a* is supported with the side stretch portion 7*a* of the seat pipe 7 to be capable of engaging with or disengaging from that portion. To put it more in detail, a support pin 7*e* of a round bar shape is secured to the side stretch portion 7*a* so as to project in the vehicle width direction. An engage-stop pipe 47*e* of a cylindrical shape secured to the lower end of the leg portion 47*a* is made capable of engaging with or disengaging from the support pin 7*e.* Part of the engage-stop pipe 47*e* on its underside and inside in the vehicle width direction is formed with a cut 47*f.*

When the entire armrest 47 is pulled out in the vehicle width direction by the above-mentioned stroke, the engage-stop pipe 47*e* is disengaged from the support pin 7*e* by the amount of the cut 47*f,* so that the armrest 47 may be rotated about the support shaft 48.

As described above, since the support bracket 47*d* at the rear end of the arm portion 47*b* of the armrest 47 is supported with the back pipe 8 while its rotation and lateral movement are permitted and the lower end of the leg portion 47*a* is removably supported with the seat pipe 7, the armrest 47 may be turned upward about the support bracket 47*d* to make the side of the seat wide open, so that no obstacle is left in the way of a person getting on and off the wheelchair. Thus, the ease of getting on and off the wheelchair is improved.

Here, since it is arranged that the entire armrest 47 is moved outward in the vehicle width direction and then rotated rearward, interference with the vehicle frame when the armrest is rotated is prevented while placing the armrest in a position that is not too much outer side in the vehicle width in the state of normal use.

Moreover, since the cylindrical engage-stop pipe 47*e* is formed with the cut 47*f,* when the armrest 47 is to be returned to the original state, first the cut 47*f* portion comes into contact with the support pin 7*e,* and in that state the entire armrest has only to be pushed in the vehicle width direction, which is a simple operation.

In this embodiment as described above, since the bar handle is made in the gate shape in a double structure made up of the inner pipe 32 (securing part) and the outer member 33 (movable part) capable of displacing relative to the pipe 32, and the sensor 42 (displacement detecting means) is provided to detect the relative displacement between the securing part and the movable part, manual operation force is detected reliably with a simple constitution.

Since the outer member 33 is formed along the upper stretch portion of the inner pipe 32, the relative displacement is detected whatever position on the outer member 33 of the bar handle 5 may be pushed. An easy operation is possible for example by a single hand.

Furthermore, the type of detecting the relative displacement amount of the outer member 33 makes it possible to constitute so that the displacement of the outer member 33 is caused by a very small manual operation force depending on the setting of the force that urges the outer member 33 toward the initial position. Therefore, it is possible to produce assisting power according to the intention of the nursing person, which is a great improvement in the ease of operation.

Since the sensor 42 is disposed in the center and the bearing members 25*a* for permitting the outer member 33 to move in the forward and rearward directions are provided on both right and left sides of the sensor 42, the detected relative displacement amount when either the right or left end of the outer member 33 is pressed for example to turn the wheelchair is smaller than the detected relative displacement amount when the central part of the outer member 33 is pressed. Therefore, the assisting power becomes smaller when turning, and so the turning operation is made easy.

Since the sensor 42 is disposed in the vehicle width center and the grips 36 are provided on both right and left sides of the outer member 33, the same relative displacement amount as that obtained when the central part is pressed is obtained by pressing the right and left grips 36, 36 with nearly equal forces when moving straight forward. Therefore, a required assisting power is obtained reliably with good ease of operation.

Since the right and left grips 36, 36 are disposed like non-parallel bars extending from right and left ends toward the center of the vehicle width with a weak upward gradient, the angles of the grips 36, 36 agree well with the palms of the nursing person, with further improvement in the ease of operation.

Since it is arranged that the driving motor 57 is controlled to rotate in the forward direction according to the relative displacement amount obtained by pressing the bar handle 5 and that the driving motor 57 is controlled to rotate in the reverse direction when the reverse switch 70*b* (first operating component) is turned on, ease of operation is good. That is, when a wheelie operation is made for example, relative displacement for the reverse movement cannot be detected, so that the problem of reverse rotation of the motor while there is no intention of moving reverse is avoided. When the wheelchair is to be moved reverse, the only thing required is to operate the reverse switch 70*b,* which is a very easy operation.

Since the operators such as the reverse switch 70*b,* the power switch 70*a* and the speed controller 70*c* and the display such as the power display 71*a* and the charge requiring 71*b*, are disposed collectively in the vehicle width center of the outer member 33 of the bar handle 5, ease of operation and visibility of the operators are improved. Since the electric components are collectively disposed in the central area, assembly work efficiency is improved.

Each of the rear wheels 49 is attached through a bracket 8*c* to the lower part 8*b* of the back pipe 8 of the right or left side frame 3. The rear wheel 49 is made up of an aluminum alloy cast wheel 50, comprising a cylindrical hub portion 50*a*, a ring-shaped rim portion 50*c,* with both of them joined into a single body through a disk portion 50*b,* and a tire 51 fitted on the rim portion 50*c*. The hub portion 50*a* is supported with a wheel shaft 53 through bearings 52, 52. The wheel shaft 53 is secured by tightening a nut 53*a* to the bracket 8*c*.

On the inside in the vehicle width direction of the wheel 50 is disposed a unit case 56 for attaching a drive unit 54 and a control unit 55. The boss portion 56*a* of the unit case 56 is secured as sandwiched between the hub portion 50*a* of the wheel 50 and the bracket 8*c* through the wheel shaft boss portion 56*b* formed integrally with the wheel shaft. A removable cover 62 covers a placing chamber 56*c* in which a control unit 55 is disposed.

The control unit 55 functions as an assisting power control means that controls the driving motor 57 to produce assisting power according to the relative displacement amount between the movable and fixed parts detected at the bar handle 5 and also as a means that controls the driving motor 57 in the reverse direction when the reverse switch 70*b* is turned on.

A cylindrical umbrella portion 56*d* is formed on the outer circumferential portion on the wheel 50 side of the unit case 56. Into the umbrella portion 56*d* is inserted an insert portion 50*d* formed cylindrically on the inside surface of the disk portion 50*b*. The outer circumferential portion of the base portion of the insert portion 50*d* is provided with an annular groove 50*e* to form a labyrinth structure to prevent rainwater or the like from entering inside.

The drive unit 54 is constituted with a planetary gear mechanism 58 connected to the output shaft 57*a* of an electric motor 57, and the output gear 59*a* of the output shaft 59 connected to the planetary gear mechanism 58 is made to mesh with a ring-shaped wheel gear 60 having internal teeth and secured to the inside end surface of the disk portion 50*b*. Both end portions of the output shaft 59 are supported with the unit case 56 through bearings 61*a,* 61*b*. To the end portion on the output shaft side of the motor 57 is fitted a motor support case 63 which is secured to the unit case 56 using tightening bolts.

The planetary gear mechanism 58 is disposed in a gear chamber 64 formed with the unit case 56 and the motor support case 63, and is made up of a sun gear 58*a* fitted to the motor output shaft 57*a,* three planetary gears 58*b* arranged to rotate around and mesh with the sun gear 58*a,* and a ring gear 58*c* having internal teeth meshing with the planetary gears 58*b*.

The planetary gears 58*b* are rotatably supported with a disk-shaped arm plate 58*d* disposed on the output shaft 59 side to be rotatable about the motor axis and with a ring-shaped arm plate 58*e* disposed on the motor side. The output shaft 59 is spline-fitted into the axial center of the arm plate 58*d*. Thus, the planetary gear mechanism 58 and the output shaft 59 are arranged on a single straight line, and the rotation of the arm plate 58*d* is transmitted from the output shaft 59 to the wheel 50.

The ring gear 58*c* is disposed to straddle both of the unit case 56 and the motor support case 63, is supported rotatably with both cases 56, 63, and is provided with a switching mechanism 65 which can stop the rotation of the ring gear 58*c*.

The switching mechanism 65 is constituted that the outer circumferential surface of the ring gear 58*c* is provided with plural, constantly spaced engage-stop recesses 58*f,* the motor support case 63 is provided with a pin 66 that can project and retract to engage with and disengage from the engage-stop recesses 58*f,* the pin 66 is urged toward the engage-stopping direction by a spring 67, and the pin 66 is also made movable in the disengaging direction by means of a cable 68.

The cable 68 is connected to a changeover switch 70*d* provided on the handle cover 34. When the switch 70*d* is turned to a normal position, the pin 66 engages with the recess 58*f*, the motor rotation is reduced with a specified reduction ratio and transmitted to the wheel 50. On the other hand, when the switch 70*d* is turned to a push-walk position, the pin 66 disengages from the recess 58*f,* and the rear wheel 49 is disconnected from the motor 57, so that the wheelchair may be easily pushed around by hand with power off.

The above point will be described more in detail: When the rotation of the ring gear 58*c* relative to the housing is disabled with the switching mechanism 65, the rotation of the electric motor 57 is reduced at a reduction ratio determined with the sun gear 57*a,* the planetary gear 58*b,* and the ring gear 58*c,* and outputted from the arm plate 58*d* to drive the rear wheel 49.

When the rotation of the ring gear 58*c* relative to the housing is permitted with the switching mechanism 65, the planetary gear mechanism 58 functions as a disengaged clutch. That is, when the wheelchair is moved manually in the state of the ring gear 58*c* being rotatable, the arm plate 58*d* rotates with the rotation of the rear wheel 49. At this time, since the sun gear 58*a* does not rotate due to the magnetic load of the motor 57, the planetary gear 56*b,* while revolving about its own axis and engaging with the sun gear 58*a* as the arm plate 58*d* rotates, rolls on the sun gear 58*a,* and the rotation of the rear wheel 49 is transmitted to the ring gear 58*c*. However, since the ring gear 58*c* is free to rotate, only the ring gear 58*c* rotates in the state of the rear wheel 49 being disconnected from the motor 57. Therefore, the planetary gear mechanism 58 functions as a clutch in a disengaged state.

Thus, this embodiment requires no dedicated clutch mechanism and makes it possible to simplify constitution, reduce the number of components, and reduce the size and weight of the drive unit 54.

Since the motor shaft 57*a* and the output shaft 59 are disposed coaxially, the number of components such as shafts and bearings may be reduced to increase axial rigidity. Since the planetary gear 58*b* is supported with the bearings that also support the motor 57 and the output shaft 59, the dimension in the axial direction may be reduced.

While the above embodiment is arranged to detect the relative displacement for the forward movement only and the reverse switch is turned on for the reverse movement, it is also possible to arrange that the relative displacement is detected for both forward and reverse movements to produce assisting power according to the detected amount. And in that case, it is arranged to control to stop the driving motor when a separately provided switch (a second operator) is turned on irrespective of the detected amount of the relative displacement. Such an arrangement is the invention according to claim 7.

According to the embodiment of the invention of claim 7, the driving motor 57 is controlled to be driven in the forward or reverse direction according to the relative displacement amount, and to be stopped when the separately provided switch is turned on irrespective of the value detected with the sensor 42. Therefore, ease of operation is improved: It is possible to move either in the forward or reverse direction easily with appropriate assisting power, and it is possible by turning the switch on to prevent assisting power in the reverse direction from being produced even if relative displacement in the reverse direction is detected as when wheelie operation is made.

FIGS. 27 to 31 are used to describe the second embodiment, the invention according to claims 9 to 14. In the figures, the same reference numerals as those in FIGS. 1 to 26 show the same or equivalent parts. While the above first embodiment is arranged to detect the relative displacement between the fixed member and the movable member as the control information, the second embodiment is arranged to detect the load applied to the outer member (operation force) as the control information.

The operating portion 81 of the bar handle 5 of the second embodiment is made up of a fixed member 82, roughly in the shape of an obtuse-angled, inverted V in front view (FIG. 27), and outer member 83 disposed to surround the fixed members 82 along them. To the right and left ends of the fixed member 82 are securely connected right and left leg portions 20, 20 in a similar constitution to that of the first embodiment.

The fixed member 82 is made up of a core 84 made of aluminum alloy casting, and round bars 85 sloping down outward in the vehicle width directions and connected to the right and left ends of the core 84. The round bar 85 and the core 84 are interconnected with a high rigidity, as the small diameter portion 85*a* is press-fitted into a connection hole 84*a* bored in either end of the core 84, and further secured with a rivet 86.

The outer member 83 is made up of a plastic-made handle cover 87 surrounding the central part, with respect to the vehicle width, of the fixed member 82 while leaving a space in between, and right and left metallic pipes 88, 88 connected to the right and left ends of the handle cover 87 to surround the round bars 85 while leaving a space in between. The right and left pipes 88 are fitted into the right and left connection openings of handle cover 87, and secured by tightening bolts 90.

A cylindrical bearing member 89 is secured to the inside of the end of the right and left pipes 88, with the inside diameter of the bearing member 89 made slightly smaller (for example by about 2 mm) than the outside diameter of the round bar 85. The round bar 85 and the bearing member 89 are respectively provided on their top and bottom sides with two flat portions 85*a* and two flat portions 89*a*, so that they can slide on each other with little gap in between. The flat portions 85*a* and 89*a* are horizontal or slightly sloping down forward.

The outer member 83 is made capable of moving only nearly horizontally or in the direction slightly sloping down forward relative to the fixed member 82 by a small amount (for example by about 1 mm) owing to the setting of the inside and outside diameters and the provision of the flat portions of the bearing members 89 and the round bars 85.

The handle cover 87 is made up of two separate pieces, an upper cover 87*a* and a lower cover 87*b*, tightened together with tightening bolts. In the upper cover 87*a* and a lower cover 87*b* are disposed two guide rods 91*a*, 91*b* disposed apart from each other in positions symmetric on both side of the longitudinal centerline of the vehicle. The guide rods 91*a*, 91*b* are inserted from the front side of the upper cover 87*a* and secured by screwing their distal ends into the nut members 92, 92 provided on the rear side of the upper cover 87*a*.

The guide rods 91*a*, 91*b* pass through guide holes 84*b* bored in the core 84. Plastic-made bearing members 93*a*, 93*b* are inserted in the axial direction from both sides of the guide holes 84*b* between the guide rods 91*a*, 91*b* and the guide holes 84*b*.

A spacing pipe 94*a* is interposed between the bearing member 93*a* for the rear side of the right side guide rod 91*a* and the rear inside surface of the upper cover 87*a*, and a spacing pipe 94*b* is interposed between the bearing member 93*b* for the front side of the left side guide rod 91*b* and the front inside surface of the upper cover 87*a*. An urging spring 95*a* is disposed over part of the guide rod 91*a* opposite the spacing pipe 94*a*, and an urging spring 95*b* is disposed over part of the guide rod 91*b* opposite the spacing pipe 94*b*.

The length of the spacing pipes 94*a*, 94*b* and the spring constant of the urging springs 95*a*, 95*b* are set in the following manner. That is, it is set that when the outer member 83 and the fixed member 82 are in the normal positional relation, no gap is present among the left side spacing pipe 94*b*, the left side bearing member 93*b*, and the front inside surface of the upper cover 87*a*; and a small gap is present among the right side spacing pipe 94*a*, the right side bearing member 93*a*, and the rear inside surface of the upper cover 87*a*.

The above arrangement permits the outer member 83 to move relative to the fixed member 82 by a small amount to transmit loads securely to the sensor. Permitting the above relative movement prevents rattle from being produced.

The core 84 is provided, in its center with respect to the vehicle width, with a sensor holding recess 84*c* having a forward opening. The opening is closed with a removable cap 96 having a sensor holding recess 96*a* and tightened with bolts 96*b*. The sensor holding recesses 84*c* and 96*a* face each other and disposed coaxially on the longitudinal center line (a) of the vehicle.

In the sensor holding recess 84*c* is disposed a magnetostriction type sensor for detecting loads (hereinafter called a load sensor) 97. In the sensor holding recess 96*a* is disposed a magnetostriction type sensor for compensation (hereinafter called a compensation sensor) 98 coaxially on the longitudinal center line (a). Both of the sensors 97, 98 are of identical specifications, disposed so that their detecting portions 97*a*, 98*a* are directed in opposite directions. A coil spring 101 as a damping member is interposed between both sensors 97 and 98.

The sensors 97, 98 are of conventionally known art to detect the magnitudes of loads utilizing the magnetostriction effect: When a load is applied to a magnetic body, the permeability and the magnetic flux density decrease.

The detecting portion 97*a* of the load sensor 97 is located in a detection hole 84*d* which is open from the sensor holding recess 84*c* toward the rear. The pressing portion 99*a* of a load transmitting member 99 is disposed opposite and to be capable of contacting the load detecting portion 97*a*. The load detection starting position of the load sensor 97 may be changed by adjusting the screwing amount of the load transmitting member 99.

In this second embodiment, a means for adjusting the relative position of the load sensor 97 and the load transmitting member 99 is provided. The means is constituted with an LED that lights up when the load transmitting member 99 is not in contact with the detecting portion 97*a* and goes out when in contact. Incidentally, for example the power display 71*a* in the first embodiment may also be used here to serve as the LED.

As described above, since the second embodiment is arranged to detect as the control information the magnitude of the load (operating force) applied to the outer member 83, the load may be reliably detected by making the outer member 83 movable by only a very small amount, for example about 1 mm. Therefore, unlike the arrangement in which the relative displacement is detected as the control information, it is little necessary to move the outer member 83 relative to the fixed member 82. As a result, rigid feeling is improved when a nursing person grips the outer member 83 to apply operating forces, and therefore natural operation feeling is obtained.

Since the flat surface portions 85*a,* 89*a* are provided on the top and bottom parts of the round bar 85 and bearing member 89 of the right and left pipes 88 so that both surfaces slide on each other with little gap in between in the direction that is horizontal or slightly sloping down forward, the outer member 83 can move relative to the fixed member 82 only in the nearly horizontal or forward down direction. Since that direction agrees with the direction of the nursing person's pushing force which is generally horizontal or slightly down forward, ease of operation is improved as the operation is made with a light force.

It is also possible to avoid the problem that, when a force is applied by hand to the bar handle to hold it from under when the front part of the wheelchair 1 is raised and the rear part is lowered, a motor drive force is suddenly produced and the wheelchair ends up in moving forward. In this point too, the ease of operation is improved.

Since the fixed member 82 is constituted with the aluminum alloy cast core 84 to which is fixed the round bar 85 and the plastic-made bearing members 93*a,* 93*b* are interposed between the guide rod 91 and the core 84, movement between the fixed and movable member is smooth, load is reliably transmitted to the load sensor 97, movement is made light, and the ease of operation is improved.

Since the load sensor 97 and the compensation sensor 98 are provided, detection errors due to variance in temperature and humidity and changes with time are prevented. That is, since the load sensor 97 is subjected to repeated loading, there may be changes in the load detection characteristic during a long period of use. On the other hand, since loads are not applied normally to the compensation sensor 98, changes in the load detection characteristic are not considered to occur for a log period of time. Therefore, loads can be detected with good accuracy over a long period of time by compensating the detection value of the load sensor 97 with the output value of the compensation sensor 98.

Since the load sensor 97 and the compensation sensor 98 are disposed to oppose each other with the damping coil spring 101 interposed in between, an excessive load is prevented from being applied to the load sensor 97 and the service life of the load sensor 97 is extended as it is prevented from being damaged.

Since the load transmitting member 99 is disposed so that its position is adjustable relative to the position of the load sensor 97 and an adjusting means (LED, or power indicator 71*a*) that lights up or goes out depending on the relative positions of the load transmitting member 99 and the load sensor 97 is provided, it is easy to adjust in case of setting an insensitive zone of the operation starting region of the load sensor 97. Concretely, an insensitive zone can be easily set in the operation starting region of the load sensor 97 by moving forward the load transmitting member 99 to a position where the light of the adjusting means goes out and then slightly moving back the load transmitting member 99. Thus, malfunction due to dimensional errors of various components is reduced, and assembly adjustment is facilitated.

FIGS. 32 to 34 are for explaining the third embodiment of the invention according to claims 15 and 16. In FIGS. 32 to 34, the same reference numerals as those in FIGS. 1 to 31 for the first embodiment stand for the same or equivalent components. This embodiment relates to improvements in the ease of operation of switches on the operation panel.

The operating section 81 of the bar handle 5 of this embodiment is made up of a fixed member 82 and an outer member 83 surrounding the operating section 81. The outer member 83 is made up of a plastic-made handle cover 87 surrounding the central part, with respect to the vehicle width direction, of the fixed member 82 with a space in between, and metallic right and left pipes (grip parts) 88, 88 surrounding, through an intervening space, round bars 85, 85 connected to the right and left ends of the handle cover 87.

The handle bar cover 87 is made up of two separate pieces, an upper cover 87*a* and a lower cover. The top surface of the upper cover 87*a* is formed to be a flat surface as an operation panel portion 87*c*. The operation panel portion 87*c* is provided with a power on-off switch 70*a,* a reverse switch 70*b*, a changeover switch 70*d,* a power display 71*a,* and a display 71*b* for indicating whether charging is required or not. These components are mounted on a base plate 41 to appear outward through the operation panel portion 87*c*.

The power on-off switch 70*a* turns power on and off by turns every time its top surface is pressed. The switch 70*a* is mounted on the base plate 41 so as to be in the switch opening 87*e* formed in the operation panel portion 87*c,* and its top surface projects above the top surface of the operation panel portion 87*c*. A surrounding wall 87*d* is raised on the circumferential edge of the switch opening 87*e* so as to surround the power on-off switch 70*a* so as to be flush with the top surface of the switch 70*a*.

A rotary switch placing portion 87*f* is formed on the top surface of the upper cover 87*a,* adjoining the left side of the operation panel portion 87*c,* and to be a step lower than the operation panel portion 87*c*.

A speed control switch (rotary switch) 110 is rotatably mounted on the rotary switch placing portion 87*f*. The switch 110 has a cup-shaped switch body 110*a,* and a three-branched operation tongue portions 110*b* formed to radially project from the lower edge of the switch body 110*a*. The operation tongue portions 110*b* are directed toward the left pipe 88 and arranged to be caught and rotated by a thumb or index finger in the state of the left hand gripping the left pipe 88. The top surface of the switch body 110*a* is inscribed with words; low speed and high speed, so that speed is controlled by rotating the words to a matching mark 87*h* provided on the operation panel portion 87*c*.

The speed control switch 110 is disposed to cap a cylindrical water-repelling wall 87*g* raise-formed on the rotary switch placing portion 87*f*, attached to a switch pin 111 rotatably disposed in the center of the water-repelling wall 87*g*, and secured to be prevented from coming off upward by means of a stop bolt 113. The switch pin 111 is adapted to be rotated together with the speed control switch 110 when it is rotated, so that the output of a controller 114 is adjusted. Incidentally, the speed control switch 110 is adapted to be held in any rotated position by causing a washer, 115 fixed to the speed control switch 110, to contact an urging spring 112 fixed on the side of the rotary switch placing portion 87*f*.

As described above, this embodiment is arranged that the rotary switch placing portion 87*f* is formed on the left hand side portion of the top surface of the handle cover 87 to adjoin the operation panel placing portion 87*c* and to be a step lower than the top surface, the speed control switch 110 is disposed on the rotary switch placing portion 87*f*, and the switch 110 is provided with the operation tongue portions 110*b* projecting toward the left pipe 88. Therefore, it is possible to catch the operation tongue portions 110*b* with the thumb or index finger and rotate the speed control switch 110 while the left hand remains gripping the left pipe 88. Thus, speed control is performed in stabilized, reliable manner.

Since the switch surrounding wall 87*d* is raised on the circumferential edge of the switch opening 87*e* formed in the operation panel portion 87*c* so as to surround the power on-off switch 70*a* to be flush with the top surface of the switch 70*a*, even if a person's palm or the like is disposed on the area including the power on-off switch 70*a*, the palm or the like is supported with the switch surrounding wall 87*d*, so that the problem of inadvertently operating the power on-off switch 70*a* is avoided.

FIGS. 35 to 37 are for explaining the fourth embodiment of the invention according to claims 18 to 20. In FIGS. 35 to 37, the same reference numerals as those in FIGS. 13, 20, and 21 for the first embodiment stand for the same or equivalent components.

In this fourth embodiment, the push handle 5 is made up of the right and left leg portions 20, 20 interconnected through an operating section 21. In the operating section 21, an inner member 80 is combined with an outer member 33 to be capable of making relative movement. The relative movement caused by human force is detected and converted into electrical signals with a sensor (potentiometer) 42. The constitution is basically the same as that of the first embodiment.

The inner member 80 is made up of right and left, solid rods 81, 81 with their inside-located ends connected with bolts 81*a* to both ends of a connecting member 82 of a roughly H-shaped cross section, in an obtuse-angled, inverted V-shape as a whole. The central top surface of the connecting member 82 is sunk to form an accommodation recess.

The outer member 33 is made up of a handle cover 34 surrounding the connecting member 82 portion of the inner member 80 while leaving an accommodation space above the connecting member 82 portion, and right and left pipes 35, 35 supported with bearing members (guides) 35*a* provided at the right and left ends of the handle cover 34, and surrounding the rod 81 portions while leaving gaps.

The bearing member 35*a* has a guide hole 35*b* of an elongate-circular cross section elongate in forward and rearward directions (normal to the drawing surface of FIG. 35). The outside-located end of the rod 81 is inserted in the guide hole 35*b*. Thus, the outer member 33 may move in the direction of longer (major) axis of the cross section of the guide hole 35*b* but the movement in the direction of shorter (minor) axis is restricted.

Here, the outer member 33 is arranged to be urged with urging springs relative to the inner member 80 in the direction toward the rear of the vehicle and, when a nursing person's hand is removed from the push handle 5, the displacement of the outer member 33 relative to the inner member 80 becomes zero.

A base plate 41 for supporting electric components such as sensors through downward projecting boss portions is bolt-secured to the inside surface of the ceiling of the upper cover 34*a*. A sensor 42 made of a direct movement type of potentiometer is attached to the underside of the base plate 41. An adjustment bolt 43 is located to oppose the detection needle 42*a* of the sensor 42. The adjustment bolt 43 is screwed into a boss portion 82*c* formed on the connecting member 82. The initial detection value of the sensor 42 may be adjusted by adjusting the screwing amount of the adjustment bolt 43.

A zero point detecting means, a microswitch 84, is attached to the underside of the base plate 41. The microswitch 84 is adapted to be on when the displacement of the outer member 33 relative to the inner member 80 is zero and, when the relative displacement amount increases to a specified amount (indicated with "a" in FIG. 37), to be off as the tongue 84*a* of the microswitch 84 is pushed in with the boss portion 82*c*. The on-to-off switching point of the switch is the zero point detecting time point.

Now referring to FIG. 37, the microswitch 84 is adapted to be switched from on to off when the displacement amount of the outer member 33 relative to the inner member 80 (relative displacement amount of the handle) reaches the specified value "a" and sends a zero point detection signal to a controller. The sensor 42 is adapted to start increasing the detected voltage from the time point "b" at which the relative displacement of the handle is slightly greater than zero. The detected voltage is inputted to the controller.

The controller is adapted to define the detected voltage value as a reference voltage value $V_0$ when the zero point detection signal is inputted from the microswitch 84, namely when the relative displacement amount of the handle is the specified displacement amount "a," and to define the detected voltage value of the sensor 42 as $V_2$ when the relative displacement amount is "c," greater than the value "a." The region between "a" and "c" is defined as a second insensitive zone, and the region below "a" as a first insensitive zone. When the relative displacement amount is beyond the second insensitive zone, the value of the current to the driving motor is controlled to be commensurate with the detected relative displacement amount of the handle. When the relative displacement of the handle decreases into the second insensitive zone, the electric current supply to the driving motor is stopped, and when it further decreases into the first insensitive zone, a reverse current is applied so that the motor functions as a generator brake. Incidentally, the method of controlling the motor in the first and second insensitive zones is not limited to that described above. For example, it is also possible to arrange that the motor current is made zero when the relative displacement amount is in the first insensitive zone, and the assist ratio is made smaller than that in the second insensitive zone when the relative displacement amount increases into the second insensitive zone.

As described above, the fourth embodiment is arranged with the microswitch 84 as a zero point detecting means, and the voltage value detected with the human force detecting means, the sensor 42, when the zero point detection signal is outputted, is defined as the reference voltage value $V_0$ to control the motor. Therefore, the attachment position of the sensor 42 is easy to adjust and the assembly work of the electric motor-operated wheelchair becomes easy.

In other words, when the microswitch 84 is not provided unlike in this embodiment, it is necessary to adjust the screwing amount of the adjustment bolt 43 so that the voltage value detected with the sensor 42 falls within a specified voltage range extending to include the reference voltage value $V_0$ under the condition of the displacement of the outer member 33 relative to the inner member 80 being set to a specified value ("a" in FIG. 37). However, that work of adjustment is very cumbersome and increases the amount of adjustment work and leads to increased assembly man-hours.

Since this embodiment is arranged to control the motor by defining the reference voltage value $V_0$ detected with the sensor 43 when a zero point detection signal is outputted, the adjustment of the sensor 42 is made by only mechanically screwing the adjustment screw 43 of the sensor 42 by a predetermined amount without requiring the cumbersome adjustment as described above.

This embodiment is also arranged that the motor is driven forward according to the relative displacement amount of the handle when the relative displacement amount is greater than "b," the motor output is made zero when the relative displacement amount is in the second insensitive zone, and the motor functions as a generator brake when the relative displacement amount is in the first insensitive zone. Therefore, when manual force is removed from the push handle 5, the relative displacement amount of the handle decreases to the value "b," and electric current supply to the motor is stopped. When the handle is pulled, the relative displacement amount is forcibly brought to the first insensitive zone, the motor works as a generator brake, and the wheelchair stops by itself. Thus, the wheelchair may be operated easily according to the intention of the operator.

FIGS. 38 to 42 are for explaining the fifth embodiment of the invention according to claims 21 and 22. In FIGS. 38 to 42, the same reference numerals as those in FIGS. 13, 20, 21, 27, and 28 stand for the same or equivalent components.

In contrast to the first to fourth embodiments above, in which the outer member of the operating section of the push handle is made movable relative to the inner member, in the fifth embodiment, the outer member is fixed to the leg portions, a movable member that may move relative to the outer member is attached to the outer member, and the relative movement amount of the movable member is detected as the human force.

The push handle 5 of the fifth embodiment is made up of right and left leg portions 20, 20 with their top ends interconnected immovably, namely to be incapable of making relative movement, through an operating section 21. The operating section 21 is made up of connecting members 20*c*, 20*c* disposed at the top of the leg portions 20, 20 and immovably interconnected through an outer member 33 within which is disposed an inner member (movable member) 80 capable of moving relative to the outer member 33 in the forward and rearward directions (normal to the drawing surface of FIG. 38). The relative movement of the inner member 80 is converted into voltage with a sensor (potentiometer) 42 and detected as human force.

The inner member 80 is made up of right and left solid rods 81, 81 with their inside-located ends connected with bolts 81*a* to both ends of a connecting member 82 of a roughly H-shaped cross section, in an obtuse-angled, inverted V-shape as a whole. The central top surface of the connecting member 82 is sunk to form an accommodation recess.

The outer member 33 is made up of a handle cover 34 surrounding the connecting member 82 portion in the center of the upper member 80 while leaving an accommodation space in between, right and left pipes 35, 35 connected to the right and left ends of the handle cover 34 and surrounding the rod 81 portions while leaving space in between, and a skin 36' made of rubber to have elasticity and covering the outside surface of the pipes 35.

The bearing member 35*a* provided in the connecting member 20*c* has a guide hole 35*b* of an elongate-circular cross section having its major axis in forward and rearward directions (normal to the drawing surface of FIG. 38). The outside-located end of the rod 81 is inserted in the guide hole 35*b* to be slidably in the major axis direction. Thus, the outer member 33 may move in the direction of major axis of the cross section of the guide hole 35*b* but the movement in the direction of minor axis is restricted.

In the upper handle covers 34*a* of the handle covers 34 are disposed two guide rods 83, 83 to extend in the vehicle's longitudinal direction in symmetric positions apart from each other by a specified distance on both sides of the vehicle's longitudinal axis, near the both ends of the connecting member 82. The guide rods 83 are secured between the front and rear walls 34*f*, 34*e* of the upper cover 34*a* through a guide cap 83*b* using a bolt 83*a* screwed through from outside.

The guide cylinder portions 82*a*, 82*a* formed on the connecting member 82 are supported through bearing members 82*b* on the guide rods 83, 83 so as to make relative (sliding) movement in the forward and rearward directions. An urging spring 40 is interposed between the front end of the guide cylinder portion 82*a* and the inside surface of the guide cap 83*b* fitted in the front side wall 34*f* of the upper cover 34*a*.

In this way, the inner member 80 is supported with the outer member 33 for relative movement only in the forward and rearward directions, and is urged to the position (reverse end position) by the spring 40 where the rear end surface 82*c* of the guide cylinder portion 82*a* contacts the inside surface of the rear side surface 34*e* of the upper cover 34*a* when the operator's hand is removed from the operating section 21.

The rod 81 is provided, on its rear and front surfaces, with a rear side ridge 81*a* and a front side ridge 81*b*. Parts of the right and left pipes 35, 35 opposite the front and rear side ridges 81*a*, 81*b* are provided with slits 35*c* through which the ridges are permitted to project or retract. When the operator's hand is removed from the operating section 21, the rear side ridge 81*a* projects rearward to bulge the rubber-made skin 36' rearward (FIG. 40(*a*)).

A sensor 42', direct motion type of potentiometer, is attached to the underside of a base plate 41 attached to the ceiling inside surface of the upper cover 34*a*. An adjustment bolt 43 is provided to oppose the detection needle 42*a* of the sensor 42'. The adjustment bolt 43 is screwed into a boss portion 82*c* formed on the connecting member 82. The initial detection value of the sensor 42' may be adjusted by adjusting the screwing amount of the adjustment bolt 43.

The sensor 42' of this embodiment, in contrast to the sensor 42 of the second embodiment described above, is arranged that the detected voltage value is small when the detection needle 42*a* is pushed in (in the state shown in FIG.

42) and the detected voltage value increases as the inner member 80 is relatively moved forward to increase the projecting amount of the detection needle 42*a*.

A zero point detecting means, a microswitch 84' is provided on the underside of the base plate 41. The microswitch 84' is adapted to be turned on as its tongue 84*a'* is pushed in with the boss portion 82*c* when the movement of the inner member 80 relative to the outer member 33 is zero, and turned off as the tongue 84*a'* rises according to the increase in the relative movement amount. A zero point is detected when the switch 84*a'* changes from on to off state.

Like the fourth embodiment, the fifth embodiment is also arranged to control the motor using the reference voltage value $V_0$ defined as the voltage detected by the sensor 42' at the time of the microswitch 84' detecting a zero point.

As shown in FIG. 40(*a*), in the state of the operator' hand removed from the push handle 5, the inner member 80 is at the reverse movement end position, the rear side ridge 81*a* is projected rearward through the slit 35*a* of the pipe 35, and the skin 36' is bulged rearward.

When the rear side ridge 81*a* moves slightly forward as the operator pushes the operating section 21, the voltage value detected with the sensor 42' becomes V1 near "b" in FIG. 37. As the rear side ridge 81*a* moves farther forward the microswitch 84' is turned from on to off (at reference symbol "a"), a zero point detection signal is outputted to a controller, and the voltage value detected here with the sensor 42' is defined to be the reference voltage value $V_0$ which is used to control the motor output.

As the operator's pushing force increases, the relative movement amount of the inner member 80 increases as shown in FIGS. 40(*b*) and 40(*c*). Accordingly the current amount supplied to the motor increases, and so the motor output increases. When the operator pulls back the operating section 21, the inner member 80, also assisted with the urging force of the urging spring 40, returns to the state shown in FIG. 40(*a*) where the current supply to the motor is stopped, and the motor functions as a generator brake.

As described above, the fifth embodiment is arranged that in the operating section 21 the inner member 80 as a movable member is disposed to be capable of making relative movement in the forward and rearward directions in the outer member 33, with the inner member formed with the front and rear side ridges 81*a*, 81*b* so as to be projected or retracted through the slit 35*c* formed in the pipe 35 of the outer member 33. Therefore, when the operating section 21 is pushed forward, the inner member 80 is pushed forward with the rear side ridge 81*a*, and a human force is detected. When the operating section 21 is pulled back, the inner member 80 is moved back with the front side ridge 81*b*, and it is clearly detected that a human force in the forward direction is not applied, which makes it possible to move the wheelchair naturally and reliably according to the operator's intention, which means a more easy operation of the wheelchair.

The fifth embodiment is also arranged that the inner member 80 is made up of right and left rods 81, 81, disposed in the right and left pipes 35, 35, with the inside-located ends of the rods 81, 81 connected to both ends of the connecting member 82, to detect the relative movement amount of the approximate center of the connecting member 82 by means of the sensor 42'. Therefore, the human force may be detected even in case only one, right or left side of the operating section 21 is operated, so that single-handed operation can be made.

FIGS. 43 to 46 are for explaining the sixth embodiment of the invention according to claim 23 in FIGS. 43 to 46, the same reference numerals as those in FIGS. 13, 20, and 21 stand for the same or equivalent components. In contrast to the above first to fifth embodiments in which the push handle is made in the gate shape by inter-connecting the top ends of the right and left leg portions through the operating section, in this sixth embodiment, the right and left leg portions are provided, at their top ends, with right and left handles.

The left handle 100 (FIG. 46) is made of a bar-shaped member 101 connected to and extending rearward from the left leg portion 20, and covered with a skin (grip) 102.

On the other hand, the right handle 103 is made of a bar-shaped member 104 connected to and extending rearward from the right leg portion 20. A movable member, or an operating section (grip) 105 is attached to the member 104 so as to be movable in the forward and rearward directions (up-down directions in FIG. 43). It is arranged that the amount of movement of the operating section 105 is detected as the human force.

The operating section 105 is made up of a pipe member 108 and a switch case 109. The outside surface of the pipe member 108 is covered with an elastic-material-made skin 108*a*. A ring-shaped slider 106 is fixed to the front end of the pipe member 108. A cylindrical holding member 107 is fixed to the rear end of the pipe member 108. The switch case 109 attached to the front end of the pipe member 108 accommodates a microswitch 84' and a sensor 42.

The slider 106 is fitted to be slidable over the bar-shaped member 104. The holding member 107 is fitted to be slidable in the forward and rearward directions over the guide portion 104*a* formed on the top end of the bar-shaped member 104 and its rear end position is restricted with a nut 104*b*. An urging spring 110 for urging the pipe member 108 toward the rear end position is interposed between the holding member 107 and the bar-shaped member 104. A cap 107*a* is provided to cover the nut 104*b*.

The sensor 42 is attached to the boss portion 106*a* of the slider 106. An adjustment bolt 43 in a position to face the detection needle 42*a* of the sensor 42 is screwed into the boss portion 104*c* formed on the bar-shaped member 104.

The microswitch 84' is attached to the underside of the base plate 41 attached to the underside of the ceiling 109*a* of the switch case 109. A shoe 111 for pushing in the tongue 84*a'* of the microswitch 84' is fitted over the bar-shaped member 104.

Under the condition of an operator's hand removed from the right handle 103, the operating section 105 is at its rear end position, the detection needle 42*a* of the sensor 42 is projected by a maximum amount as shown in FIG. 44 and a small clearance is present between the needle and the adjustment screw 43, and its detected voltage is a minimum of V1 shown in FIG. 37. As shown in FIG. 45, the microswitch 84' is turned on as its tongue 84*a* is pushed in.

When the operator pushes the operating section 105 to move it slightly forward, the voltage value detected with the sensor 42 starts to increase from V1 shown in FIG. 37. When it is farther moved forward, the output of the microswitch 84' changes from on to off state (reference symbol "a"), a zero point detection signal is outputted to a controller. The voltage value detect here with the sensor 42 is the reference voltage value $V_0$ which is used as reference to control the motor output.

As the operator's operating force increases, the relative movement amount of the operating section 105 increases, the amount of current supplied to the motor increases, and the output of the motor increases. When the operator pulls back the operating section 105, the operating section 105, accelerated with the urging spring 110, returns immediately to the state shown in FIGS. 44 and 45, where the current supply to the motor is stopped, and the motor functions as a generator brake.

According to this sixth embodiment, the grip 105 located at the rear part of the right handle 103 is made capable of making relative movement in the forward and rearward directions, and the human force is detected from the relative movement of the movable grip 105, the human force may be detected even when only the right hand side grip 105 is pushed. Therefore, single-handed operation is possible. Moreover, the constitution is simpler than the case of using the gate-shaped push handle, which leads to reduced number of components and costs.

INDUSTRIAL APPLICABILITY

According to the invention of claim 1, since the bar handle is made in a double structure made up of the fixed member and the outer member, and a detecting means for detecting control information according to external forces acting on the outer member is disposed between the fixed member and the outer member, operating forces are detected reliably with a simple constitution.

Moreover, since the outer member is made in the shape extending along the upper side portion of the fixed member, the operating force may be detected whatever point on the upper side portion of the bar handle may be pressed.

According to the invention of claim 2, since the bar handle is made in a gate shape in a double structure made up of the fixed portion and the outer portion, and a displacement detecting means for detecting the displacement of the movable portion relative to the fixed portion is provided, operating forces are detected reliably with a simple constitution.

Moreover, since it is a type of detecting the relative displacement amount of the movable portion, it is possible to constitute that the relative displacement of the movable portion is caused even with a very small operational force depending on the setting of the force of urging the movable portion toward the initial position. Therefore, assisting forces commensurate with the operator's intention may be produced to greatly improve the ease of operation. FY5E According to the invention of claim 3, since the displacement detecting means is disposed in the center and the guides for moving the movable portion in the forward and rearward directions are, provided on right and left sides of the displacement detecting means, when turning for example, the detected amount of relative displacement when either right or left side of the movable portion is pressed becomes smaller than that when the central part of the movable portion is pressed. Therefore, assisting force becomes small when turning, and the turning operation becomes easy. Incidentally, if a type in which right and left wheels are driven according to the output from a single displacement detecting means is constituted that the same assisting force is produced whether the end or central part of the movable portion is pressed, the operator might feel as if the wheelchair fled away forward from the operator when the operator pushes one end of the movable portion while intending to turn.

According to the invention of claim 4, since the displacement detecting means is disposed in the center with respect to the vehicle width, and grips are provided on the right and left sides of the movable portion, when moving straight, by pressing the right and left grips with nearly equal forces, a relative displacement amount is obtained that is the same as that when the central part is pressed. Thus, any required assisting force is reliably obtained with good ease of operation.

According to the invention of claim 5, since the right and left grips are positioned symmetrically apart and slightly sloping down outward on both sides of the vehicle's longitudinal center line, the slightly sloping angle of the grips agrees well with the sloping angle of the operator's palms reaching for the grips, so that the ease of operation is further improved.

According to the invention of claim 6, since it is arranged to control the driving motor to rotate in the forward direction according to the relative displacement amount produced by pressing the bar handle, and in the reverse direction when the first operating component is turned on, the ease of operation is good. That is, in case for example a wheelie operation is made, a relative displacement in the reverse direction is not detected. This prevents the problem of unwanted reverse rotation of the motor. Moreover, since only the operation of the first operating component suffices to move reverse, operation is easy.

According to the invention of claim 7, since it is arranged to control the driving motor to rotate in the forward or reverse direction according to the relative displacement amount and to control the motor to stop irrespective of the amount detected with the displacement detecting means when the separately provided second operating component is turned on, the wheelchair may move easily with appropriate assisting force whether in forward or reverse direction. In case a wheelie operation is to be made for example, if the second operating component is held in the turned-on position, reverse assisting force is not produced even if a relative displacement in the reverse direction is detected. In this respect too, the ease of operation is good.

According to the invention of claim 8, since the operating components such as the reverse switch, the power switch, and the speed controller and the displays such as the power display, the display indicating whether charging is required or not, and anomaly display are collectively disposed in the vehicle width center area of the outer member of the bar handle, the operability of the operating components and the visibility of the displays are improved. Moreover, since the electric components are collectively disposed in the central area, ease of assembly is improved.

According to the invention of claim 9, since the load detecting means is provided to detect the magnitude of the load applied to the outer member as the control information, unlike the arrangement in which the relative displacement is detected as the control information, there is little need of moving the outer member relative to the inner member, so that the outer member may be improved in rigidity to provide a natural feeling of operation.

According to the invention of claim 10, since the magnetostriction type of sensor for detecting loads and the magnetostriction type of sensor for compensating the output of the load detection sensor are provided, detection errors due to variance caused by changes in temperature and humidity and changes with time are prevented from occurring. That is, it is conceivable that changes in the load detecting characteristic occur in the magnetostriction type of sensor for detecting loads due to constantly repeated application of loads over a long period. On the other hand, it is considered that no change occurs in the load detecting characteristic of the compensation-purpose magnetostriction sensor over a long period because normally no load is applied to the sensor. Therefore, it is possible to detect loads with good accuracy over a long period of time as the output value of the load detecting magnetostriction sensor is compensated with the output value of the compensating magnetostriction sensor.

According to the invention of claim 11, since the load detecting magnetostriction sensor and the compensating magnetostriction sensor are disposed to face each other with a damping member interposed in between, excessive loads in particular are prevented from being applied to the load detecting magnetostriction sensor and the sensor is prevented from being damaged, so that the service life is secured.

According to the invention of claim 12, since the load transmitting member is positioned to be adjustable relative to the load detecting magnetostriction sensor, load is securely transmitted to the sensor to improve the load detection accuracy.

According to the invention of claim 13, since the adjustment means is provided which lights up or goes out according to the relative positions of the load transmitting member and the load detecting magnetostriction sensor, the load detection accuracy is further improved, and the adjustment is easy in case an insensitive zone is to be set particularly in the operation starting region of the sensor. In case for example the above adjustment means is arranged to light up when the load transmitting member is not in contact with the sensor, an insensitive zone may be easily and securely set in the operation starting region of the sensor by first advancing the load transmitting member to a point where the adjusting means lights up and then retracting it a little, so that malfunction of the sensor due to dimensional errors etc. of various components is prevented and the work of assembly and adjustment is facilitated.

According to the invention of claim 14, since it is arranged that control information is outputted when a load is applied to the outer member in the direction that is horizontal or slightly sloping down forward, in case for example the bar handle is supported by hand from under when the rear part of the wheelchair lowers, an inconvenience of the wheelchair moving forward undesirably is avoided.

According to the invention of claim 15, it is arranged that the rotary switch placing portion is formed on one side of the top surface of the handle cover to be a step lower than the operation panel portion, the rotary switch is rotatably disposed on the placing portion, and the rotary switch is provided with operation tongue portions projecting toward the grip portion side. Therefore, the ease of the switch operation is improved as the rotary switch may be rotated by catching the operation tongue portions with the index finger or the thumb while gripping the grip portion by hand.

According to the invention of claim 16, since the surrounding wall is raise-formed on the circumferential edge of the switch opening formed in the operation panel so as to surround the push switch to be approximately flush with the top surface of the switch, even if a person's palm or the like is disposed on the area including the push switch, the palm or the like is supported with the switch surrounding wall, so that the problem of inadvertently operating the push switch is avoided.

According to the invention of claim 17, the forward movement of the wheelchair is made by the forward drive of the motor which is cause by simply pushing the push handle, and the reverse movement is made only by operating the operating component without detecting human force. Therefore, the operation is simple.

Moreover, since no human force detection is made in the reverse movement direction, the problem of unwanted reverse rotation of the motor on a downhill or in wheelie operation is avoided. That the wheelie operation is separated from the reverse operation is still another improvement in the ease of operation.

According to the invention of claim 18, since the zero point detecting means is provided and the motor is controlled by using a value, detected with the human force detecting means when a zero point detection signal is outputted, as a reference value, the human force detecting means may be adjusted easily, which results in that the wheelchair may be assembled easily.

In other words, in case no zero point detecting means is provided, it is necessary to adjust the relative positions of the human force detecting means and the movable portion of the push handle under the condition of the displacement of the push handle relative to the vehicle body frame being set to a specified value, so that the value detected with the human force detecting means falls within a specified voltage range. However, since the above adjustment work is very cumbersome, adjustment man-hours increase and also assembly man-hours increase. According to the present invention, however, since the motor is controlled using a reference value, namely the value detected with the human force detecting means when a zero point is detected with the zero point detecting means, the cumbersome adjustment work as mentioned above is unnecessary.

According to the invention of claim 19, since the zero point detecting means is provided, the insensitive zone may be divided into the first and second ones, which makes it possible to control the motor according to the first and second insensitive zones, and more fine control becomes possible, so that the wheelchair is moved smoothly.

Incidentally, if the zero point detecting means were not provided, the insensitive zone must be set using only the value detected with the human force detecting means. However, since the detected value has variance, it is impossible to divide the insensitive zone. According to the present invention, however, since the zero point detecting means of on-off type is provided, the zero point is clear, which makes it possible to divide the insensitive zone. Incidentally, it is also possible to divide the insensitive zone into three or more zones by providing plural number of zero point detecting means. In that way, finer motor control is possible.

According to the invention of claim 20, since it is arranged that the motor output is made zero when the value detected with the human force detecting means is in the second insensitive zone, and the motor is used as a generator brake when the value is in the first insensitive zone, the motor output becomes zero when no force is applied to the push handle, and then the motor works as a generator brake, so that the operation of the wheelchair becomes smoother and easier.

According to the invention of claim 21, since the movable member is disposed in the operating section of the push handle so as to be movable in the forward and rearward directions and the movable member is adapted to project or retract in the forward and reverse directions through slits formed in the operating section, the movable member advances when the push handle is pushed forward, and retracts when the push handle is pulled back. Therefore, human force may be reliably detected from the movement of the movable member, so that the wheelchair may be operated more easily.

According to the invention of claim 22, since it is arranged that the right and left movable members are disposed in the right and left grip portions and that the right and left movable members are interconnected through the connecting member to detect the relative displacement amount of the approximate central portion of the connecting member, human force may be detected even in case only one, right or left side of the operating section is operated, so that the wheelchair may be operated by a single hand.

According to the invention of claim 23, since it is arranged that the push handles are made up of the right and left leg portions and the right and left grips attached to the top ends of the leg portions, and that one of the grips is made movable in the forward and rearward directions to detect human force from the relative displacement of the movable grip, human force may be detected even when only the movable grip is pushed, so that single-handed operation is possible, and the number of components and costs are reduced.

What is claimed is:

1. A pushing, electric motor-operated wheelchair, a frame provided with a seat for a patient, at least one wheel journalled by said frame and driven by in electric motor carried by said frame, a bar handle extending upward from a rearward portion of said frame and having a cross piece of a double member structure consisting of a fixed member attached to and extending transversely across said frame and an external member disposed along at least a substantial portion of the length of an upper side portion of said fixed member and supported for limited movement relative thereto and to which an assistant applies a force to move said wheelchair; a detecting means interposed between said fixed member and said external member to detect control information based on an external force applied by the assistant to said external member to move said wheelchair, and a control for controlling said electric motor to produce assisting power commensurate with the control information detected by said detecting means.

2. A pushing, electric motor-operated wheelchair according to claim 1, wherein the detecting means detects relative displacement between the fixed member and the external member, and the control controls the electric motor to produce assisting power commensurate with the detected displacement.

3. A pushing, electric motor-operated wheelchair according to claim 1, wherein the detecting means comprises a load detecting means for detecting the magnitude of the load applied to the external member and the control controls the electrical motor so as to produce assist power commensurate with the detected load.

4. A pushing, electric motor-operated wheelchair according to claim 1, wherein the detecting means outputs control information based on die external force acting on the external member in a horizontal direction.

5. A pushing, electric motor-operated wheelchair according to claim 1, wherein the external member is provided with a handle cover disposed in the transverse center of the wheelchair, and further includes right and left grip portions extend respectively in right and left directions from said handle cover, a top surface of said handle cover comprises an operation panel portion, said operation panel portion having a depressed part at one side thereof forming a rotary switch placing portion and further including a rotary switch disposed in said rotary switch placing portion.

6. A pushing, electric motor-operated wheelchair according to claim 1, wherein the external member is provided with a handle cover disposed in the wheelchair width center, and right and left grip members extend respectively from right and left from said handle cover, a top surface of said handle cover is formed as an operation panel portion, a push switch mounted in a switch hole formed in said operation panel portion and projecting upward from said top surface of said operation panel portion, and a switch circumferential wall formed around said switch hole so as to surround said push switch and lying substantially flush with a top surface of said push switch.

7. A pushing, electric motor-operated wheelchair according to claim 2, wherein the displacement detecting means is disposed in the center, with respect to the wheelchair width, of at least one of the fixed member and the external member, and guides are provided on right and left sides of said displacement detecting means to restrict up and down movements and to permit forward and reverse movements of said external member relative to said fixed member.

8. A pushing, electric motor-operated wheelchair according to claim 2 wherein the displacement detecting means is disposed in the center, with respect to the wheelchair width of at least one of the fixed member arid the external member, and grip members are provided an right and left sides of said external member.

9. A pushing, electric motor-operated wheelchair according to claim 2 wherein the control controls the electric motor to move forward according to the magnitude of the relative displacement between the fixed member and the movable member caused by pressing the upper side portion of the bar handle, and controls the driving motor to move backward when a separately provided first operator is turned on.

10. A pushing, electric motor-operated wheelchair according to claim 2, wherein the control controls the electric motor to move forward or backward according to the magnitude of the relative displacement between the fixed member and the movable member of the bar handle, and controls said electric motor to stop irrespective of the value detected with the displacement detecting means when a separately provided second operator is turned on.

11. A pushing, electric motor-operated wheelchair according to claim 8, wherein the right and left grip members are positioned symmetrically apart from the longitudinal centerline of the wheelchair and sloping obliquely up inward to the center in the wheelchair width direction from right and left ends.

12. A pushing, electric motor-operated wheelchair according to claim 9 wherein operators selected from the group consisting of a reverse switch, a power switch, and a speed regulation device and displays selected from the group consisting of a power display, a display for indicating the necessity of charging, and an anomaly display are collectively disposed in the center, with respect to the wheelchair width of the external member of the bar handle.

13. A pushing, electric motor-operated wheelchair according to claim 10 wherein operators selected from the group consisting of a reverse switch, a power switch, and a speed regulation device and displays selected from the group consisting of a power display, a display for indicating the necessity of charging, and an anomaly display are collectively disposed in the center, with respect to the wheelchair width, of the external member of the bar handle.

14. A pushing, electric motor-operated wheelchair according to claim 3, wherein the detecting means comprises a magnetostriction sensor for detecting the load and a magnetostriction sensor for compensating the output from the load-detecting magnetostriction sensor.

15. A pushing, electric motor-operated wheelchair according to claim 14, wherein the load-detecting magnetostriction sensor and the output-compensating magnetostriction sensor are disposed to face each other and a damping member is interposed between the two sensors.

16. A pushing, electric motor-operated wheelchair according to claim 14, wherein a load transmitting member for transmitting load to the load-detecting magnetostriction sensor is adjustably attached to the external member for adjust ment of its position relative to the load-detecting magnetostriction sensor.

17. A pushing, electric motor-operated wheelchair according to claim 16, wherein an indicator displays the relative positions of the load transmitting member and the load-detecting magnetostriction sensor.

18. A pushing, electric motor-operated wheelchair according to claim 5 wherein the rotary switch is provided with operation tongue portions projecting toward the grip member.

* * * * *